US005282738A

United States Patent [19]

Oshima et al.

[11] Patent Number: 5,282,738

[45] Date of Patent: Feb. 1, 1994

[54] LIQUID FUEL FEEDING METHOD AND LIQUID FUEL BURNING APPARATUS

[75] Inventors: Hiroo Oshima; Takehiko Shigeoka, both of Nara, Japan

[73] Assignee: Matsushita Electric Industrial Co., Ltd., Osaka, Japan

[21] Appl. No.: 873,476

[22] Filed: Apr. 24, 1992

[30] Foreign Application Priority Data

| | | | |
|---|---|---|---|
| Apr. 26, 1991 | [JP] | Japan | 3-96640 |
| May 23, 1991 | [JP] | Japan | 3-118254 |
| Dec. 10, 1991 | [JP] | Japan | 3-325499 |
| Feb. 3, 1992 | [JP] | Japan | 4-17364 |

[51] Int. Cl.[5] ..... F23N 5/20; F23D 5/12

[52] U.S. Cl. ..... 431/3; 431/6; 431/119; 431/29; 431/208; 417/417; 417/446; 417/297

[58] Field of Search ..... 431/3, 6, 11, 29, 30, 431/31, 208, 117, 118, 119; 123/467, 497, 514; 222/108, 110, 113, 333, 504; 141/116, 117, 120; 417/417, 297, 446; 239/5, 88, 109, 119

[56] References Cited

U.S. PATENT DOCUMENTS

| | | | |
|---|---|---|---|
| 2,686,562 | 8/1954 | MacCracken et al. | 239/119 |
| 4,665,881 | 5/1987 | Wade | 123/467 X |
| 4,838,232 | 6/1989 | Wich | 123/458 X |

FOREIGN PATENT DOCUMENTS

| | | | |
|---|---|---|---|
| 0037624 | 3/1982 | Japan | 431/29 |
| 0058006 | 4/1982 | Japan | 431/118 |
| 0122816 | 7/1985 | Japan | 431/6 |
| 0202010 | 9/1986 | Japan | 431/6 |
| 2044408 | 10/1980 | United Kingdom | 431/119 |

*Primary Examiner*—Carl D. Price
*Attorney, Agent, or Firm*—Ratner & Prestia

[57] ABSTRACT

The liquid fuel burning apparatus includes a fuel tank, a burning unit for burning the fuel, an electromagnetic pump for sucking the fuel from the tank, a feeding pipe for feeding the sucked fuel to the burning unit, and a control unit for controlling the electromagnetic pump. The electromagnetic pump has a plunger which is reciprocated by a plunger solenoid to suck the fuel in the fuel tank and discharge the sucked fuel therefrom in the associative motion of a suction and a discharge valves incorporated therein. The control unit opens the valves for a predetermined time when the fuel supply is stopped. Thus, fuel remained at an end of the feeding pipe is collected from so that the unburnt gas or strange smell which would be generated when the unnecessary liquid fuel is supplied to the burning means can be restricted.

25 Claims, 20 Drawing Sheets

LIQUID FUEL FEEDING METHOD AND LIQUID FUEL BURNING APPARATUS

BACKGROUND OF THE INVENTION

1. Field of the Invention

The present invention relates to a liquid fuel feeding method and to a liquid fuel burning apparatus, and more particularly, to a method of feeding liquid fuel to a warm air circulator, and to a warm air circulator employing said method.

2. Description of the Prior Art

As shown in FIG. 18, in a conventional liquid fuel burning apparatus of the kind referred to above, an electromagnetic pump 602 is provided above a tank 601 which contains liquid fuel. The electromagnetic pump 602 sucks the liquid fuel from the tank 601 and feeds the sucked fuel to a burning unit 604 through an fuel feed pipe 603.

In FIG. 19, an evaporating unit 604 which is located inside the burning unit 604 is shown. The evaporating unit 604 is heated to high temperature by a heater 605 so that the fuel supplied from a nozzle 607 provided at an end of the fuel feed pipe is evaporated and mixed with the burning air fed through an air throat 608. The mixture of evaporated fuel and air is jetted out from a flame opening 609 of the evaporating unit 606 for burning.

Meanwhile, as shown in FIG. 20, the electromagnetic pump 602 drives a discharge valve 611 and a suction valve 612 in accordance with the up-and-down movement of a plunger 610, thereby sucking the fuel from the tank 601 for feeding to the burning unit 604 through the fuel feed pipe 603.

In the above-described structure, however, the liquid fuel which is not used and remaining inside the fuel feed pipe 603 within the burning unit 604 is expanded as a result of the temperature rise of the fuel feed pipe or nozzle 607 facing to the inside of the evaporating unit 606 of the burning unit 604. Thus, thermally expanded fuel in the fuel feed pipe 603 is fed to the burning unit 604 through the nozzle and the evaporating unit 606 even when the electromagnetic pump 602 is stopped.

For instance, although the fuel feed pipe 603 in the vicinity of the burning unit 604 and the nozzle 607 face the high temperature ambience during the burning of the fuel, the fuel feed pipe 603 and nozzle 607 are cooled by the liquid fuel sucked up from the tank 601 by the pump 602. In contrast, when burning is stopped, supply of the liquid fuel sucked from the tank 2 is interrupted. The cooling effect on pipe 603 or nozzle 607 by the liquid fuel is lost, whereby the temperature of the liquid fuel in the fuel feed pipe 603 and nozzle 607 raises rapidly, causing feed of the expanded fuel to the burning unit 604 with a little delay from the stop of burning. The expanded fuel in pipe 608 and nozzle 609 is then dropped in the evaporating unit 606 of the burning unit 604, thus generating a large quantity of unburnt gas, horrible smell and tar, etc.

At the ignition time as well, the liquid fuel remaining in the fuel feed pipe 603 and nozzle 607 is expanded due to the temperature rise of the evaporating unit 606 before the ignition, and evaporated in the evaporating unit 606 of the burning unit 604, thus resulting in generation of a large deal of unburnt gas, smell and tar, etc.

The above phenomenon is particularly apparent when the temperature of the fuel feed pipe 603 and nozzle 607 is ready to rise immediately after the electromagnetic pump is stopped. This gives the user greatly uncomfortable feeling.

SUMMARY OF THE INVENTION

The present invention has been developed with a view to substantially solving the above described disadvantages and has for its essential object to provide an improved liquid fuel burning apparatus.

A liquid fuel burning apparatus for burning a liquid comprises a tank means for reserving the liquid fuel, a sucking means for sucking the liquid fuel reserved in the tank means, a burning means for burning the liquid fuel, a feeding means connected with the sucking means and the burning means for feeding the sucked liquid fuel to the burning means, and a control means for controlling the sucking means and burning means. The control means controls the sucking means to suck the liquid fuel from the tank when a burning starts and to return the sucked liquid fuel to the tank means when a burning stops.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

Figure 2:
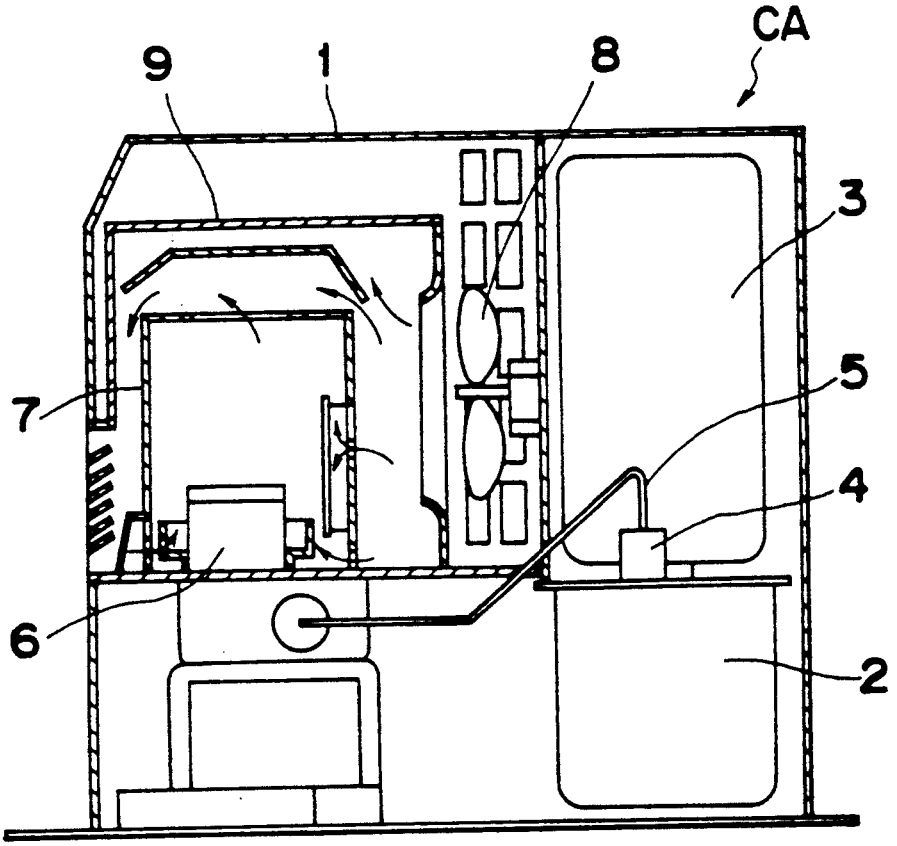
FIG. 2 is a cross sectional view of a warm air circulator using the apparatus shown in FIG. 1

In the first, referring to FIG. 2, an inner view of a warm air circulator CA using a liquid fuel feeding apparatus according to the present invention, viewed from the front side thereof is shown. The warm air circulator CA includes a tank for reserving the liquid fuel on a right side within a casing 1. A detachable cartridge 3 which is a portable fuel carrier is placed above the tank 2 to supplement the fuel to the tank 2. A electromagnetic pump 4 is further provided on the tank 2 to suck the liquid fuel reserved therein. A burning unit 6 is provided on the left side within the casing 1, and is connected to the pump 4 by a fuel feed pipe 5, through which the fuel sucked from the tank 2 is fed to the burning unit 6. As a combustion chamber of the fuel, a burning cylinder 7 is provided surrounding the burning 6. A duct 9 having a opening on the right side wall thereof is provided over the burning cylinder 7. A convection fan 8 is provided on the right side of the duct 9 for supplying air therethrough.

Figure 1:
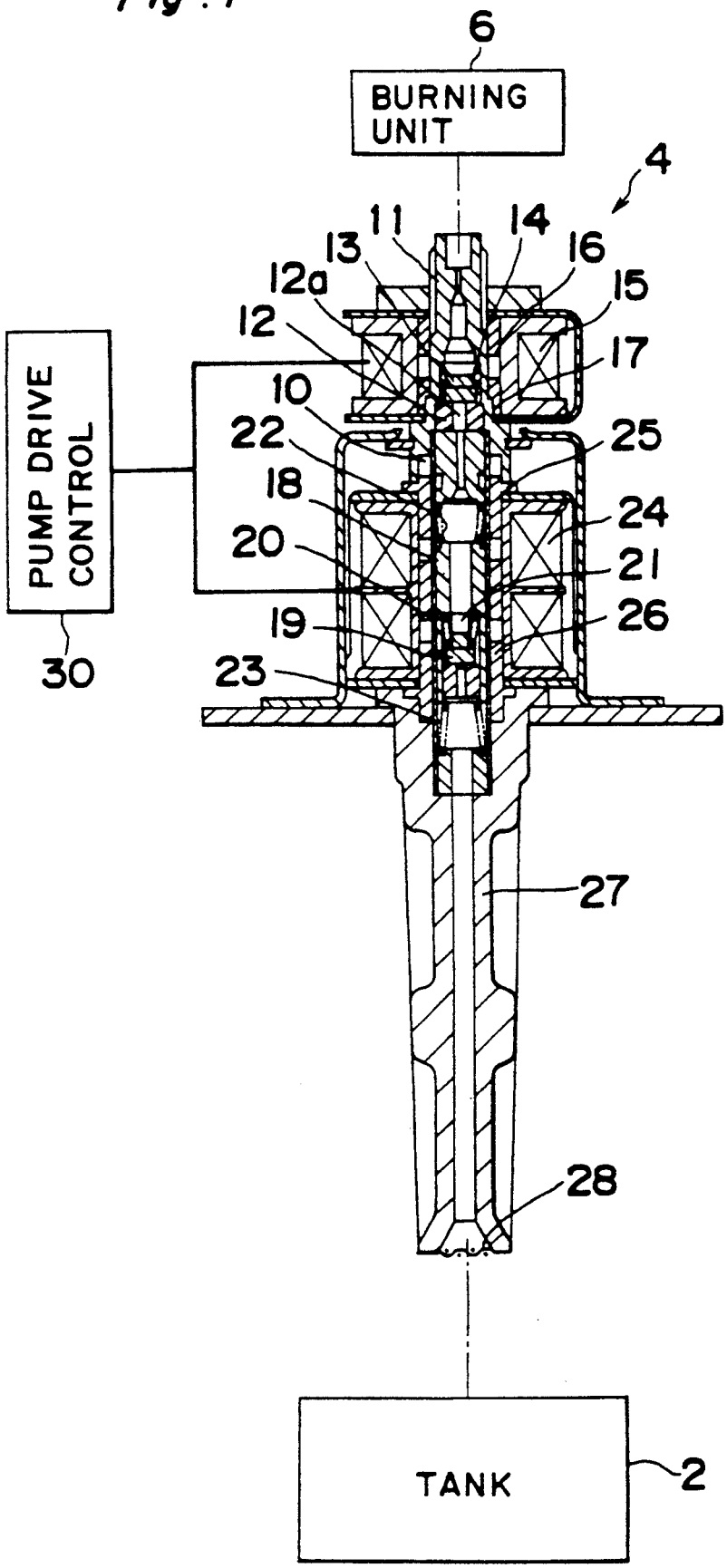
FIG. 1 is a cross sectional view of an electromagnetic pump used in a liquid fuel burning apparatus according to a first embodiment of the present invention.
Figure 3:
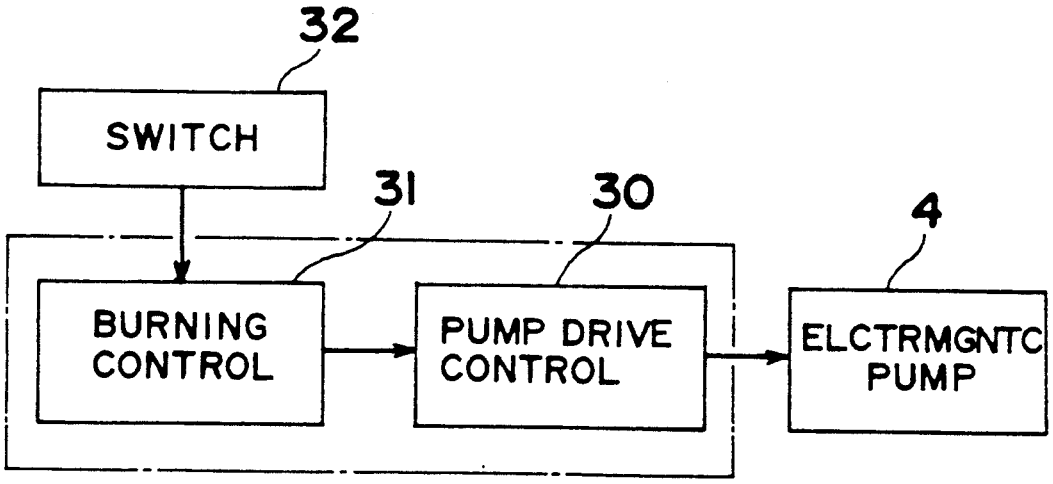
FIG. 3 is a block diagram of a control units of the liquid fuel burning apparatus shown in FIG. 1.

Referring to FIG. 1, the electromagnetic pump 4 and control units are shown. The pump 4 has a tubular column 10 forming a circulation passage of the liquid fuel, a discharge coupling part 11 which is coupled to the fuel feed pipe 5 i connected to the part 11. Inside the discharge coupling part 11, a valve seat 12 having a discharge port 12*a* is provided. A discharge valve 13 of a magnetic material is provided above the part 11 so as to open or close the port 12*a*. A discharge spring 14 is provided within the part 11 to bias the valve 13 to close the port 12*a*. A discharge solenoid 15 is provided around the part 11 to open and close the discharge vale 13. There are arranged an upper magnetic discharge path 16 and a lower magnetic discharge path 17 between the discharge solenoid 15 and the discharge coupling part 11. The upper magnetic path 16 draws up to open the discharge valve 13 by the magnetic force of the discharge solenoid 15. The lower magnetic path 17 is spaced below the upper magnetic path 16 and transmits the magnetic line of force. Thus, the discharge valve 13 is actuated to open when the liquid fuel is discharged to the burning unit 6, whereas it is actuated to close by the discharge spring 14 when the liquid fuel is sucked from the tank 2. A plunger 18 below the discharge valve seat 12 is moved up and down, having a suction valve part 21 thereinside. When the plunger 18 is moved downward, the suction valve part 21 opens a suction valve 19 thereby to suck the liquid fuel into between the suction valve part 21 and valve seat 12. On the other hand, when the plunger 18 is moved upward, the suction valve part 21 closes the suction valve 19 by a suction spring 20 thereby to press the liquid fuel upward. Springs 22 and 23 are provided to support and bias the plunger 18 in a vertical direction against the gravity. A plunger solenoid 24 in the circumference of the tubular column 10 moves the plunger 18 up and down. An upper magnetic path 25 is defined between the plunger solenoid 24 and tubular column 10 for transmitting the magnetic force from the plunger solenoid 24 to raise the plunger 18. A lower magnetic path 26 is formed a distance below the upper magnetic path 25 to transmit the magnetic line of force. A suction pipe 27 is formed in the lower part of the tubular column 10. A mesh of filter 28 at the lowest end of the suction pipe 27 prevents dusts or the like from entering the inside of the column 10. Referring to FIG. 3, a pump drive control unit 30 is provided to control the power sully to the discharge solenoid 15 and the plunger solenoid 24 of the pump 4 in response to an output from a burning control unit 31. The burning control unit 31 operates in compliance with a start instruction from an operation switch 32, and generates a burning start instruction to the pump drive control unit 30 based on a preset program. The burning control unit 31 and pump drive control unit 30 controls the supply of the fuel following the procedures described in flow charts of FIGS. 4, 5, 6 when burning is started or stopped.

In the above-described structure of the electromagnetic pump 4, the fuel is supplied from the cartridge 3 into the tank 2 in a manner to maintain a predetermined level. Then, the fuel is sent to an evaporating unit (not shown) of the burning unit 7 through a nozzle (not shown) at an end of the fuel feed pipe 5 by the electromagnetic pump 4. The fuel evaporated in the evaporating unit is burnt to produce a burnt gas in the burning unit. The burnt gas exhausted from the burning unit is guided upward by the burning cylinder 7 and is mixed with the indoor air sent from the convection fan 8 inside the duct 9. Subsequently, the mixed gas is discharged and utilized as the warm air.

Figure 4:
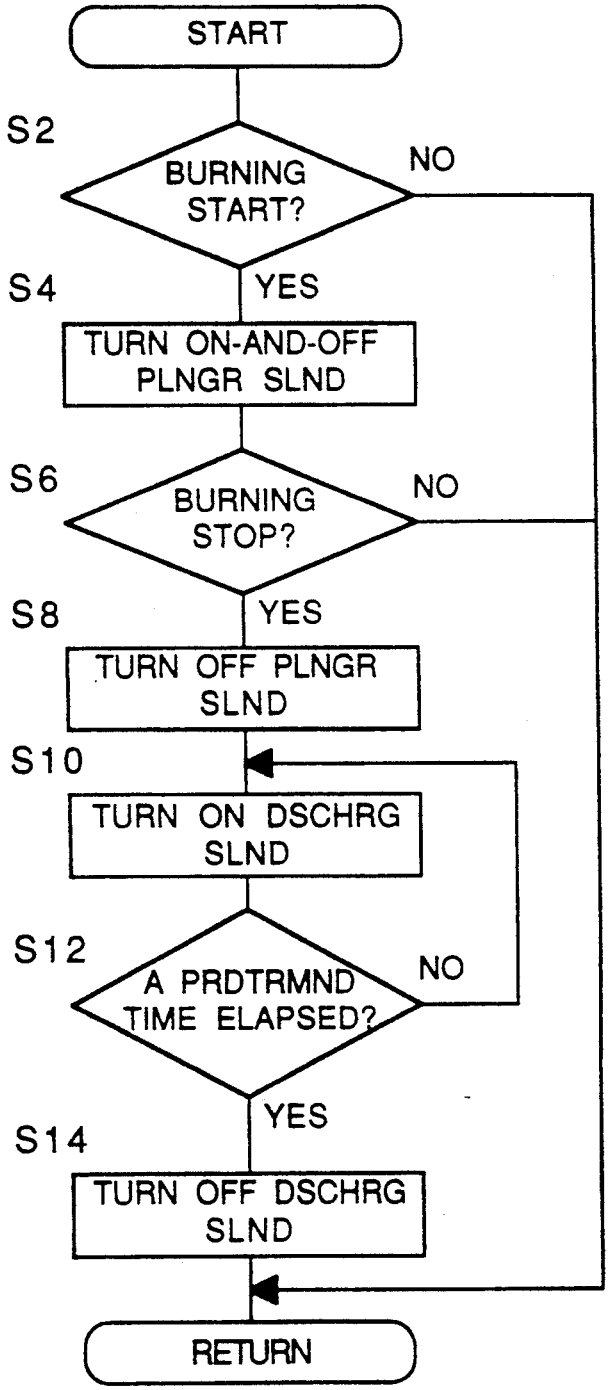
FIG. 4 is a flow chart showing the operation of the control unit of the apparatus shown in FIG. 3 at the extinguishment time.

Referring to FIG. 4, a flow chart of liquid fuel feeding operation according to a first embodiment of the present invention is shown. Upon detection of the burning start instruction by the burning control unit 31, judged as "YES" at step S2, the pump drive control unit 30 is actuated to turn on and off the plunger solenoid 24 by impressing a pulse voltage at step S4. As a result, the plunger solenoid 24 is driven for starting the burning process. More specifically, when the plunger solenoid 24 is turned on, a magnetic field is generated from the solenoid 24 through the upper magnetic path 25, plunger 18, lower magnetic path 26 to the plunger solenoid 24, thereby raising the plunger 18 upward. At this time, the discharge valve 13 is opened and the suction valve 19 is closed, so that the liquid fuel in the space between the valve seat 12 and plunger 18 is, through the discharge port 12*a* of the valve seat 12, discharged out to the fuel feed pipe 5 connected to the discharge coupling part 11. When the power supply to the plunger solenoid 24 is interrupted, the plunger 18 is lowered to the original position by the springs 22 and 23. At this time, the discharge valve 13 is closed, whereas the suction valve 19 is opened. Therefore, the liquid fuel sucked through the suction pipe 27 is filled between the valve seat 12 and plunger 18. By repeatedly turning on and off the plunger solenoid 24, the liquid fuel in the tank 2 is, after passing through the filter 28, sucked from the suction pipe 27 and supplied to the burning unit 6 via the nozzle at the end of the fuel feed pipe 5.

Subsequently, when a burning stop instruction is detected at step S6, the plunger solenoid 24 is turned off at step S8. At step S10, the discharge solenoid 15 is turned on and until when an elapse of a predetermined time is detected at step S12, the operation returns to step S10. At step S14, the discharge solenoid 15 is turned off at step S14. Thus, during this predetermined period, a magnetic field is generated from the discharge solenoid 15 through the upper magnetic discharge path 16, discharge valve 13 and lower magnetic discharge path 17 to the discharge solenoid 15, whereby the discharge valve 13 is raised upward to be opened. Accordingly, since the opening part of the nozzle of the pipe 5 is positioned higher than the fuel level in the tank 2, the fuel remaining therein is sucked through a slight gap of the discharge port 12*a*, plunger 18 and tubular column 10 because of the above difference in height between the opening part of the nozzle and the fuel level in the tank 2. Therefore, not smaller than the expanded amount of the liquid fuel in the nozzle at the end of the fuel feed pipe 5 is returned to the electromagnetic pump 4 or tank 2.

Accordingly, it can be prevented that the expanded amount of the liquid fuel due to the temperature rise in the fuel feed pipe 5 and nozzle is supplied to the burning unit 6 when burning is stopped, thereby restricting undesirable generation of a large quantity of unburnt gas, odd smell or tar and ensuring favorable burning for a long time.

Figure 5:
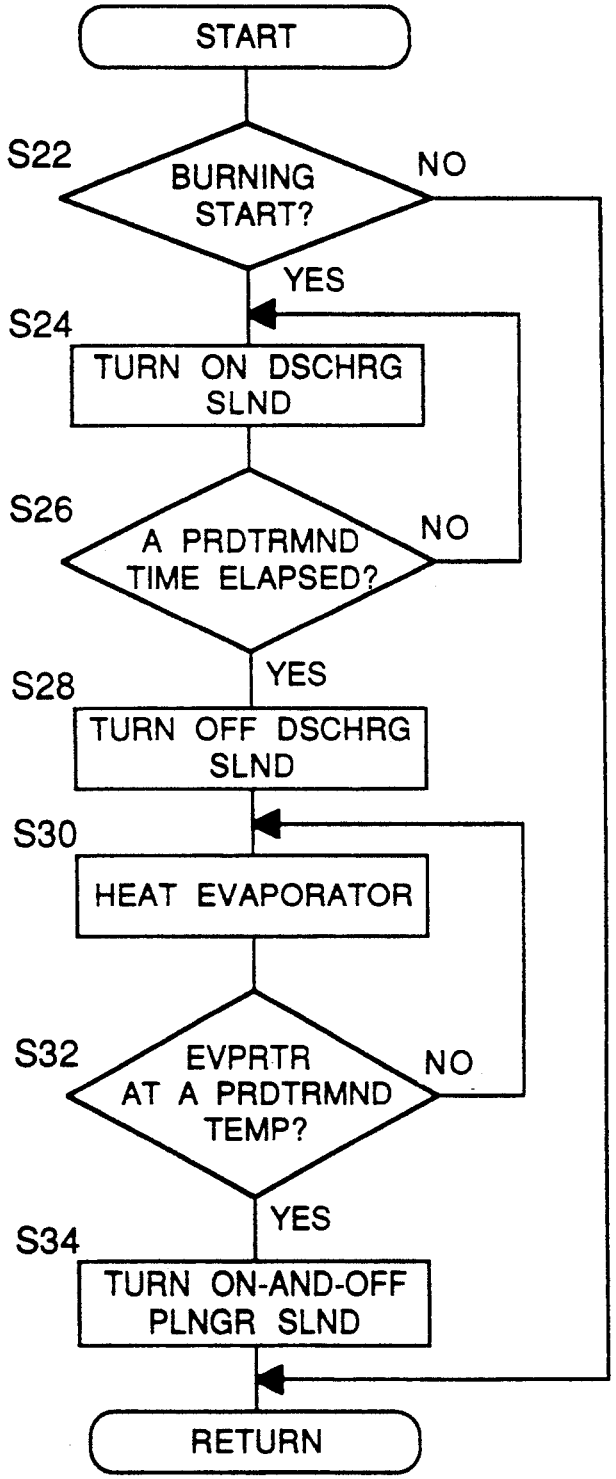
FIG. 5 is a flow chart showing an alternative operation of the control unit shown in FIG. 3 at the ignition time.

Referring to FIG. 5, a flow chart of liquid fuel feeding operation of an alternation of the first embodiment for solving the problems at the ignition time is shown. The structure of the controlling unit is the same as described above.

When a burning start instruction is detected at S22, the burning control unit 31 sends the instruction to drive the pump drive control unit 30. The pump drive control unit 30 in turn keeps the discharge solenoid 15 as turned on state for a predetermined time (several seconds) at steps S24 and S26, and opens the discharge valve 13. During this time, the liquid fuel in the nozzle at the end of the fuel feed pipe 5 is, as mentioned earlier, returned via the discharge port 12*a* in the principle of a siphon due to the difference in height between the opening part of the nozzle and fuel surface in the tank 2.

Thereafter, the power supply to the discharge solenoid 15 is stopped at step S28 to close the discharge valve 13. Then, the burning control unit 31 starts to heat the evaporating unit at step S30. When it is judged that the evaporating unit reaches a predetermined temperature at step S32, the plunger solenoid 24 is turned on and off at step S34, thereby starting burning. In this case, even though the temperature of the fuel feed pipe 5 and nozzle is raised consequent to the temperature rise of the evaporating unit, the fuel in the nozzle is already returned to the electromagnetic pump 4 and tank 2 as described before, and prevented from being expanded out to the burning unit 6. In this manner, it becomes possible to achieve good burning for a long time, with restricting generation of the unburnt gas, strange smell or tar.

Figure 6A:
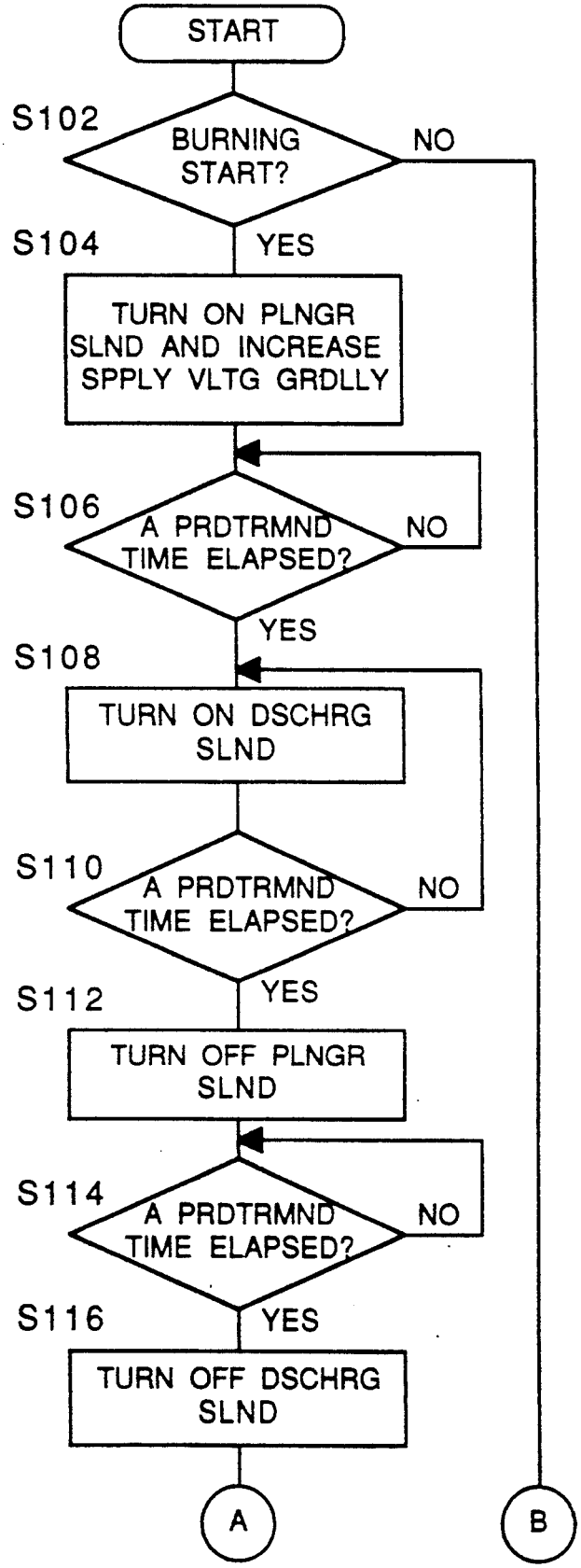
FIGS. 6A and 6B are flow charts showing another alternative operation of the control unit shown in FIG. 4.
Figure 6B:
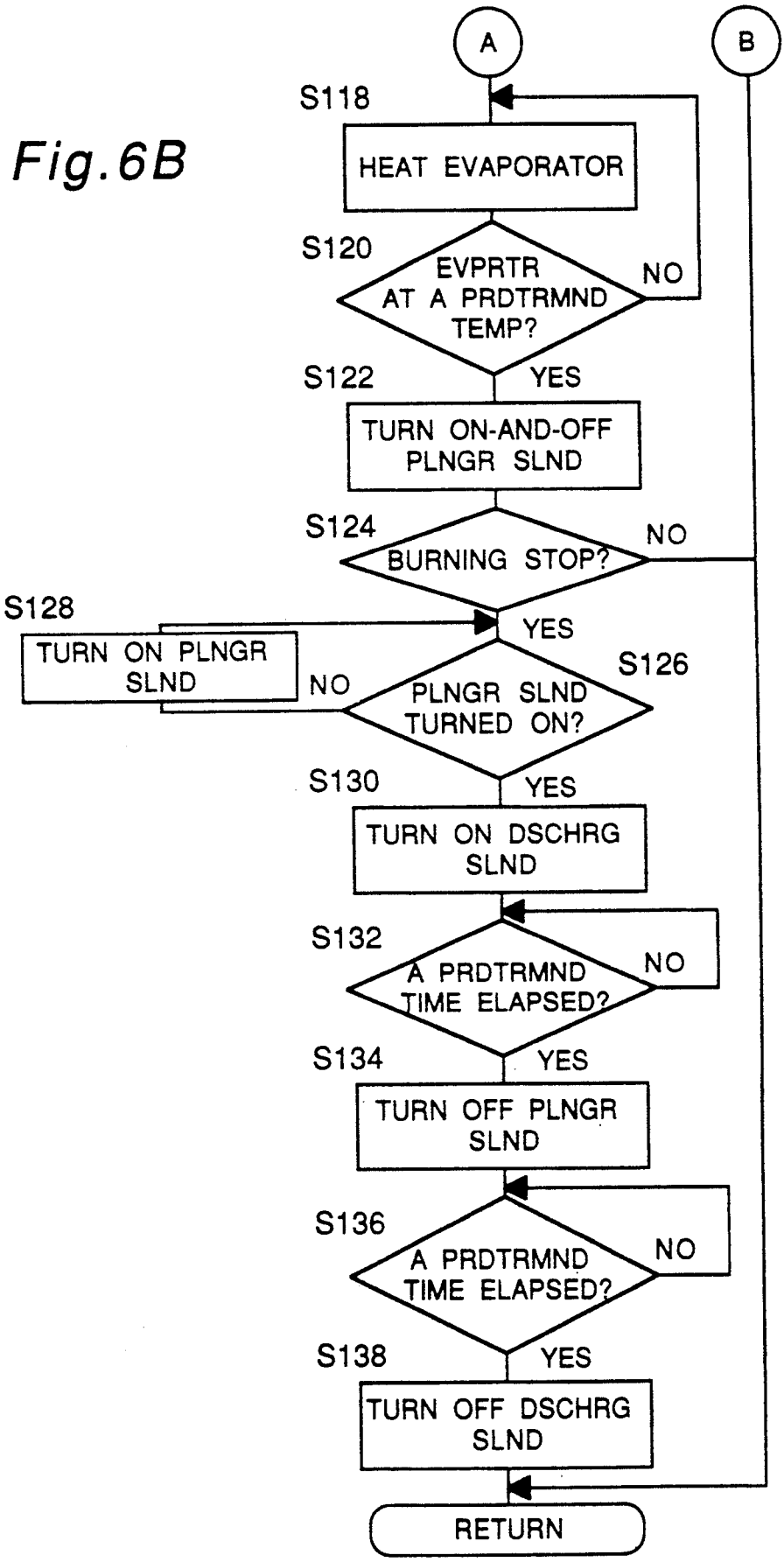

Referring to FIG. 6, a flow chart of liquid fuel feeding operation of another alternation of the first embodiment, for reducing the bad smell both at the ignition time and at the extinguishment time by returning the fuel more positively, is shown. Upon detection of a burning start instruction at step S102, the burning control unit 31 transmits the instruction to the pump drive control unit 30 and, the pump drive control unit 30 supplies electricity to the plunger solenoid 24 in a manner to gradually increase the voltage at step S104. The plunger 18 is gently raised upward. After detection of an elapse of a predetermined time at S106, resulting in that the plunger 18 is held at that raised position for a while, the electricity is continuously supplied to the discharge solenoid 15 to turn on for a predetermined time (several seconds) at steps S108 and S110, with opening the discharge valve 13. If the opening part of the nozzle is higher than the fuel level in the tank 2, the liquid fuel in the nozzle at the end of the fuel feed pipe 5 is returned through the discharge port 12*a* into the tank 2. A preset time later, the power supply to the plunger solenoid 24 is cut at step S216. As a result, the plunger 18 is immediately lowered, and the fuel is sucked from the nozzle at the end of the fuel feed pipe 5 by the suction force generated when the plunger is lowered. After elapsing a predetermined time for ensuring such suction of fuel, detected at step S114, the supply of electricity to the discharge solenoid 15 is stopped at step S116. The burning control unit 31 starts heating of the evaporating unit at step S118. When the temperature of the evaporating unit becomes a predetermined value at step S120, the plunger solenoid 24 is turned on and off at step S122, thereby starting burning.

Upon receipt of a burning stop instruction at step S124, the plunger solenoid 24 is supplied with a power to turn on at steps S126 and 128, keeping the plunger 18 at the raised position. The discharge solenoid 15 is turned on at step S130 and is kept turned on a predetermined time (several seconds) at step S132. In other words, since the plunger 18 is raised upward and held there, the liquid fuel is stopped to be discharged, and burning is stopped. Moreover, as the discharge valve 13 is kept opened for the predetermined time (step S132), the fuel is returned from the opening part of the nozzle at the end of the fuel feed pipe 5 if the nozzle is higher than the fuel surface in the tank 2 as described before.

After a predetermined time has passed at step S223, the power supply to the plunger solenoid 24 is cut OFF at step S136. Consequently, the plunger 18 is brought down to the original position, whereby the fuel in the fuel feed pipe 5 is sucked by the suction force. The power supply to the discharge solenoid 15 is stopped at step S138.

In this manner, even if the opening part of the nozzle is lower than the fuel surface of the tank 2, the fuel can be positively sucked by the movement of the plunger 18, and therefore the expanded fuel component of the liquid fuel resulting from the temperature rise in the fuel feed pipe 5 and nozzle at the ignition time or extinguishment time is not supplied to the burning unit 6, thus reducing the unburnt gas, strange smell, tar or the like and realizing good burning for a long term.

Referring to FIGS. 7, 8, 9, and 10, a liquid fuel burning apparatus according to a second embodiment of the present invention is shown. More specifically, the liquid fuel burning apparatus having a more simplified structure than that of the apparatus which sucks the liquid fuel by the plunger as described with reference to FIGS. 1 and 6.

Figure 7:
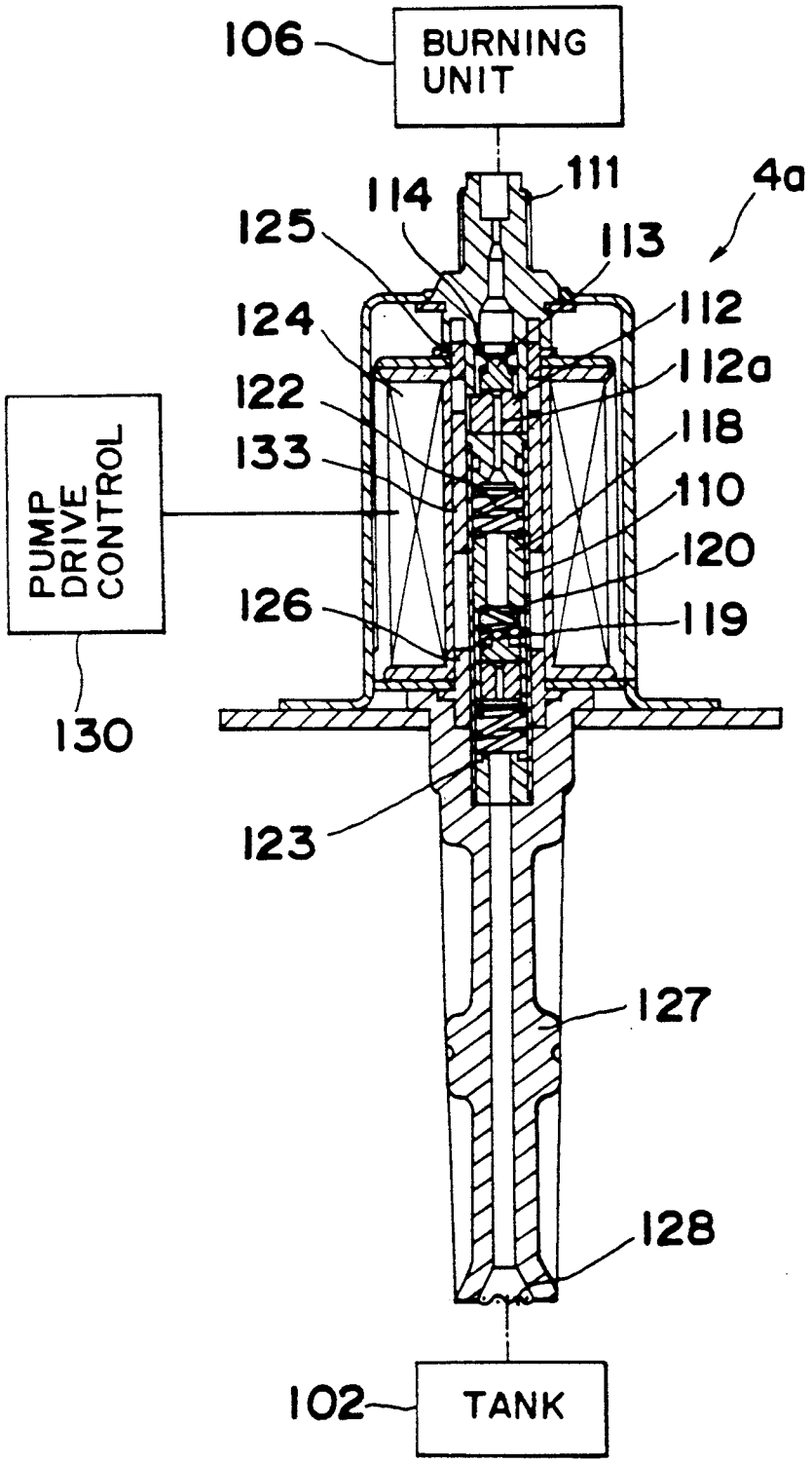
FIG. 7 is a cross sectional view of an electromagnetic pump used in a liquid fuel burning apparatus according to a second embodiment of the present invention.

In FIG. 7, an electromagnetic valve 4*a* has a plunger solenoid 124 provided also in the outer periphery of a discharge valve 113 to open the discharge valve 113. An upper magnetic path 125, an intermediate magnetic path 133 and a lower magnetic path 126 are defined between the plunger solenoid 124 and a tubular column 110. The upper magnetic path 125 transmits the magnetic line of force from the plunger solenoid 124 thereby to draw the discharge valve 113 upward, while the intermediate magnetic path 133 raises the plunger 118 upward. The lower magnetic path 126 is spaced below the intermediate magnetic path 133 to transmit the magnetic line of force. The operating sequence of a burning control unit 131 (not shown) and a pump drive control unit 130 is as indicated in the flow chart of FIG. 8, 9 or 10. Other than the above described components, the valve 4a is constructed by a discharge coupling part 111 connected to a burning unit 106 via feeding pipe 105 (not shown), a valve seat 112 provided with a discharge port 112a, a discharge spring 114, a plunger 118, a suction valve 119, a suction spring 120, springs 122 and 123, and a suction pipe 127 with a mesh of filter 128 dipped into a tank 102 in a structure similar to that of the first embodiment, as shown in FIG. 7.

Figure 8:
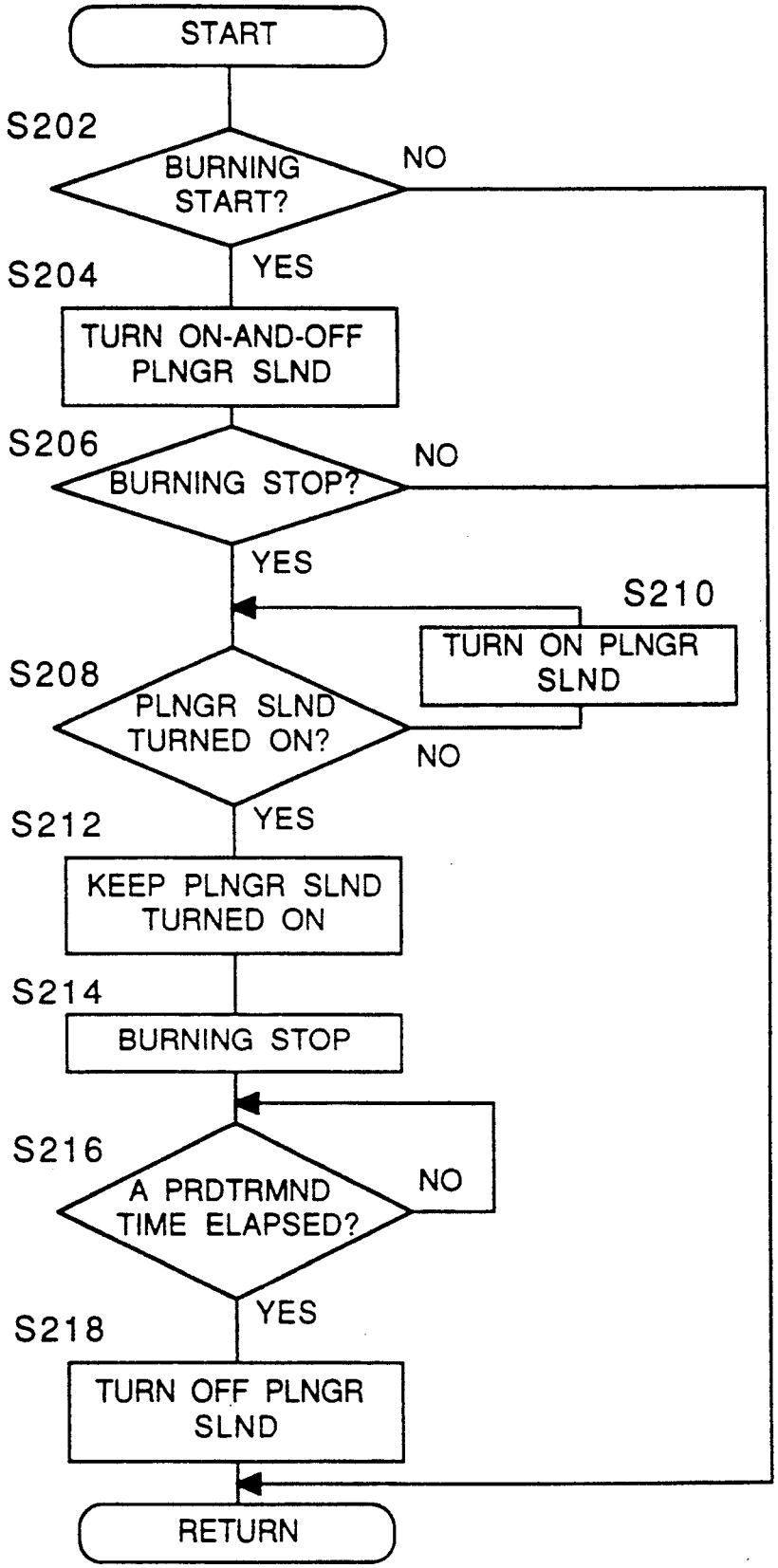
FIG. 8 is a flow chart of the operation of a controlling unit of the apparatus shown in FIG. 7 at the extinguishment time.

Referring to FIG. 8, a flow chart of liquid fuel feeding operation according to the second embodiment of the present invention is shown. Upon detection of the burning start instruction by the burning control unit 131 at step S202, the pump drive control unit 130 is actuated to turn on and off the plunger solenoid 124 at step S204. That is, when the power is fed to the plunger solenoid 124, there is generated a magnetic field from the plunger solenoid 124 through the upper magnetic path 125, discharge valve 113, intermediate magnetic path 133, plunger 118, lower magnetic path 126 to the plunger solenoid 124. The discharge valve 113 is raised and opened, so that the plunger 118 is raised upward. At this time, the suction valve 119 is closed and the liquid fuel in the space between the valve seat 112 and plunger 118 is discharged to the fuel feed pipe 105 (not shown) coupled to the discharge coupling unit 111 through the discharge port 112a of the valve seat 112. When the power supply to the plunger solenoid 124 is stopped, the discharge valve 113 is closed by the spring 114 and the plunger 118 is lowered to the original position by the springs 122 an 123. Since the suction valve 119 is opened, the liquid fuel is sucked into between the valve seat 112 and plunger 118 through the suction pipe 127. As the power supply to the plunger solenoid 124 is repeatedly turned on and off, the liquid fuel in the tank 102 is sucked from the suction pipe 127 through the filter 128 to the burning unit 106 via the fuel feed pipe 105.

At step S206 burning stop instruction is detected, the plunger solenoid 124 is turned on at steps S208 and S210 and is kept on for a predetermined time (several seconds) at step S212, causing the discharge valve 113 to open to maintain the plunger in the raised state. Since the plunger 18 is held at the raised position, the discharge of the liquid fuel is stopped, causing the burning to stop at step S214. The discharge valve 13 is kept opened for a predetermined time. If the nozzle at the end of the fuel feed pipe 5 is higher than the fuel surface in the tank, similar to the aforementioned embodiment, the liquid fuel in the nozzle of the fuel feed pipe 5 is returned according to the principle of a siphon.

After a predetermined time at step S216, the supply of power to the plunger 118 is cut off at step S218. Therefore, the plunger 118 is moved down to the original position, with the discharge valve 113 being closed. The liquid fuel in the fuel feed pipe 105 is further sucked through the discharge port 112a and returned to the electromagnetic pump 4a or the tank 102.

Accordingly, in the liquid fuel burning apparatus of the second embodiment shown in FIGS. 7 and 8, the discharge valve 113 is opened by one plunger solenoid 124, thereby simplifying the structure. Moreover, even if the opening part of the nozzle is at the lower position than the fuel surface of the tank 102, the fuel can be positively sucked by the motion of the plunger 118. Because of these reasons, it is prevented that a large sum of unburnt gas, strange smell or tar is generated, and favorable burning is ensured for a long term.

Figure 9:
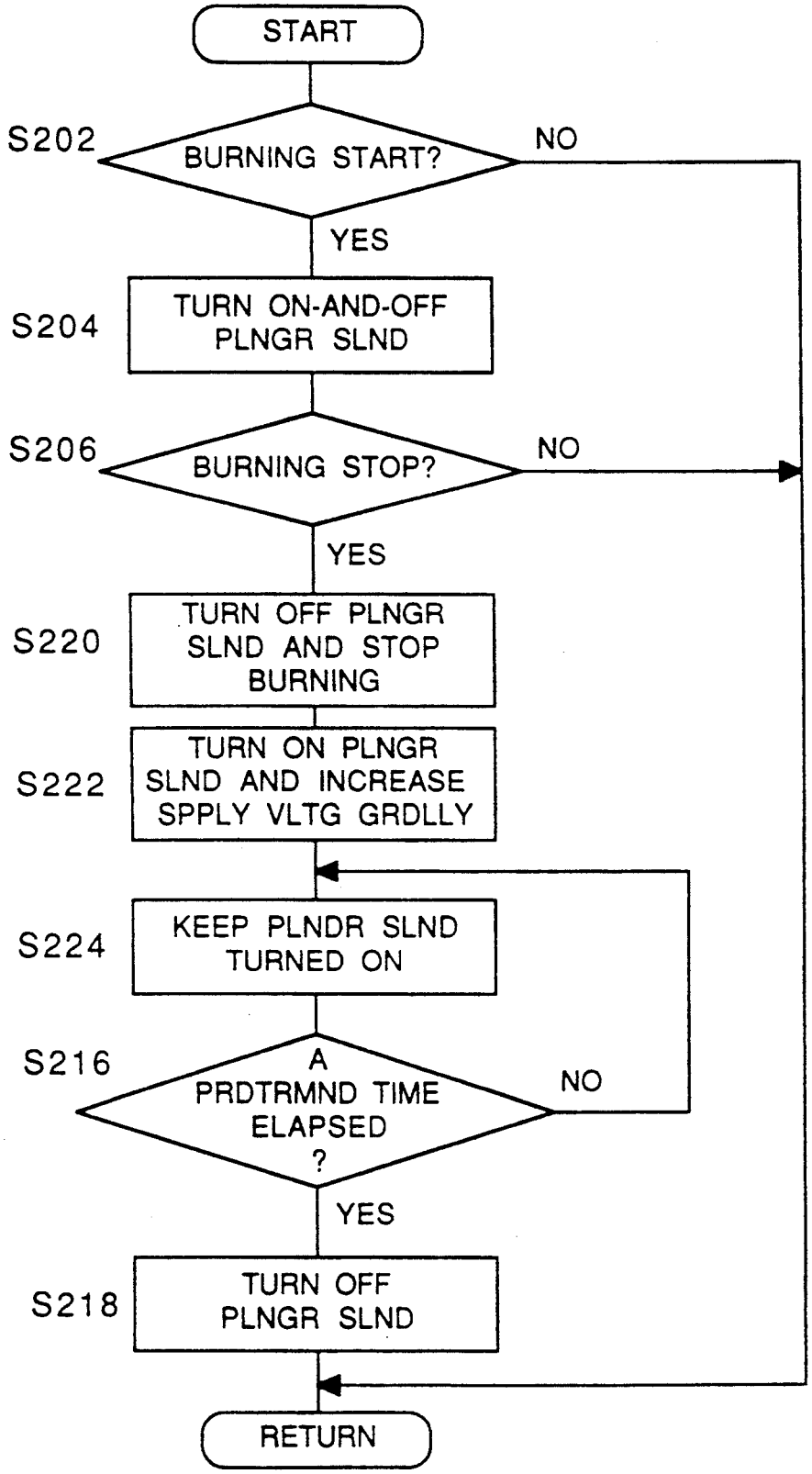
FIG. 9 is a flow chart of an alternative operation of the control unit of the apparatus shown in FIG. 7 at the extinguishment time.

Referring to FIG. 9, a flow chart for an alternative controlling operation of the plunger solenoid 124 shown in FIG. 8 is shown. Specifically, steps S208, S210, S212, and S214, in FIG. 8 are replaced by steps S220, S222, and S224 in FIG. 8. In this case, when a burning stop instruction is generated at step S206, the power supply to the plunger solenoid 124 is once turned off at step S220 to stop burning. Thereafter, the plunger solenoid 124 is turned on again at step S222. The voltage supplied to the plunger solenoid 124 is gradually increased so as to forcibly open the discharge valve 113 while the plunger 118 is softly moved upward to restrict the discharge of the fuel. This state is maintained for a predetermined time (several seconds) at steps S224 and S216. The discharge valve 113 is opened and the plunger 118 is held at the raised position. As a result, the liquid fuel in the nozzle at the end of the fuel feed pipe 105 is returned to the electromagnetic pump 4a or tank 102 by the amount not smaller than the expanded fuel component.

A predetermined time later at step S216, the power supply to the plunger solenoid 124 is stopped, and therefore the plunger 118 is lowered to the original position. Simultaneously with this, the discharge valve 113 is closed, so that the liquid fuel in the fuel feed pipe 105 is returned through the discharge port 112a even if the opening part of the nozzle is lower than the fuel surface of the tank 102.

Figure 10:
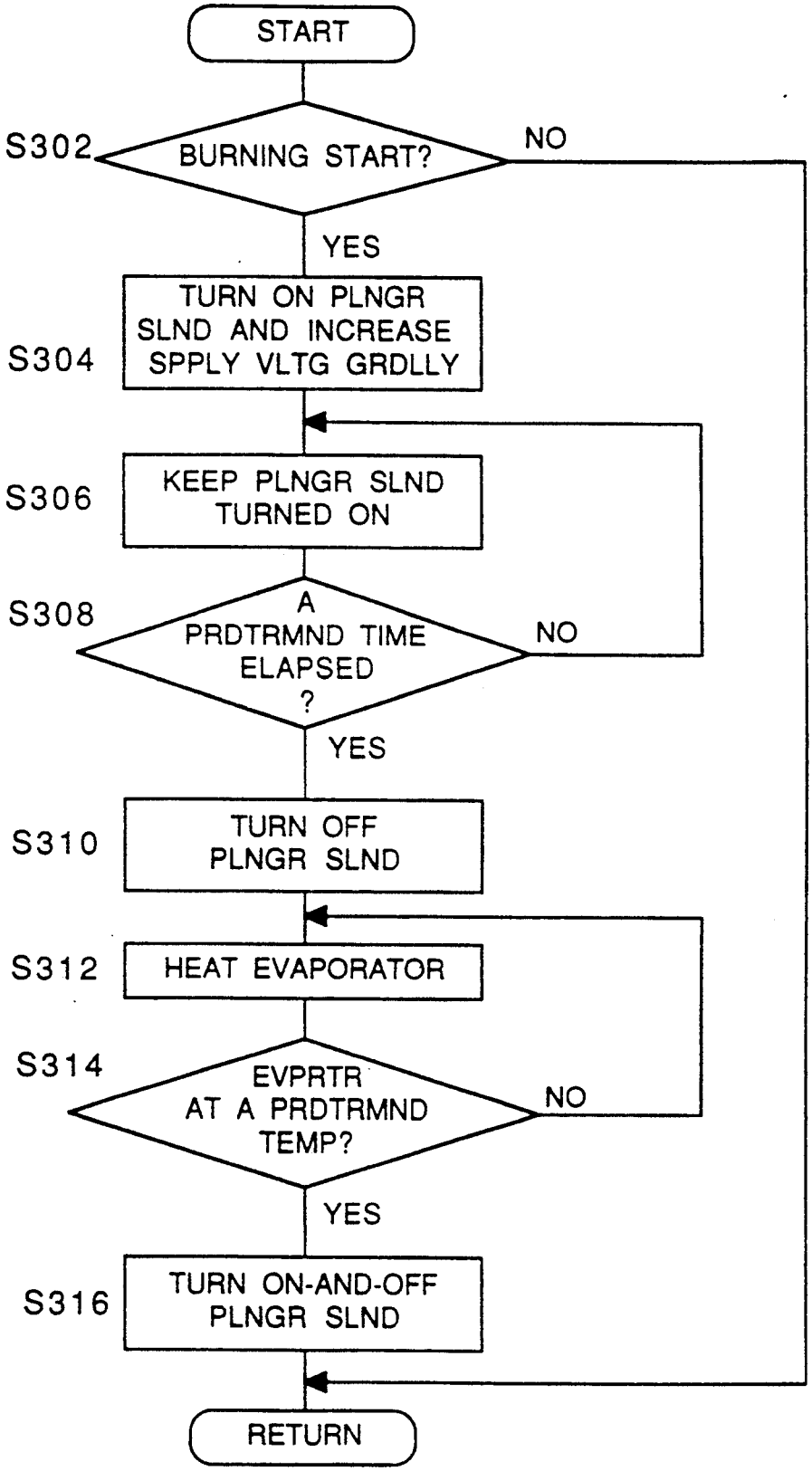
FIG. 10 is a flow chart of another alternative operation of the control unit of the apparatus shown in FIG. 7 at the ignition time.

Referring to FIG. 10, a flow chart for another alternative controlling operation of the burning control unit 131 and pump drive control unit 130 to solve the problems at the ignition time is shown. Although the structure is the same as already described above, a difference of the operating sequence will be discussed below. When a burning start instruction is detected at step S302, the burning control unit 131 transmits the instruction to the pump drive control unit 130. The pump drive control unit 130 makes power supply to the plunger solenoid 124 at step S304. The supplying voltage to the plunger solenoid 124 is gradually increased so as to forcibly open the discharge valve 113 while the plunger 118 is raised moderately to control the discharge of the fuel. After this state is kept for a predetermined time (several seconds) at steps S306 and S308, the discharge valve 113 is opened to maintain the plunger 118 in the raised state.

That is, since the discharge valve 113 is kept opened for a predetermined time as the plunger 118 is drawn upward, the liquid fuel in the nozzle at the end of the fuel feed pipe 105 is returned back owing to the level difference. After a predetermined time later, the plunger solenoid 124 is turned off at step S310. The plunger 118 is promptly dropped, and therefore the fuel in the nozzle at the end of the fuel feed pipe 105 is sucked and positively returned to the electromagnetic pump 4a or tank 102.

The burning control unit 131 starts heating of the evaporating unit at step S312. When the evaporating unit reaches a predetermined temperature at step S314, the power supply to the plunger solenoid 124 is intermittently repeated to start burning at step S316. Even if the temperature of the fuel feed pipe 105 or nozzle is raised in accordance with the temperature rise of the evaporating unit before starting of burning, the fuel within the nozzle, etc. has been returned to the electromagnetic pump 4*a* or tank 102 without being expanded outside. Therefore, undesirable generation of the unburnt gas, smell or tar can be restricted, and favorable burning is carried out for a long term.

Referring to FIGS. 11, 12, 13, and 14, a liquid fuel burning apparatus according to a third embodiment of the present invention is shown, wherein the stroke of the plunger at the ignition time or at the extinguishment time is made larger than during the normal operation, so that the sucking effect of the plunger is improved. More specifically, the plunger solenoid 224 is divided in upper and lower two stages, i.e., an upper solenoid 224B and a lower solenoid 224C. An upper magnetic path 234, an intermediate magnetic path 235 and a lower magnetic path 236 are arranged with a distance from one another between the plunger solenoid 224 and tubular column 210 to transmit the magnetic line of force from the upper and lower solenoids 224B and 224C. The other points of the structure is very similar to the apparatus as shown in FIG. 1 such that an electromagnetic valve 4*b* has a discharge coupling part 211 coupled to a fuel feed pipe 205 (not shown), a valve seat 212 provided with a discharge port 212*a*, a discharge valve 213 of a magnetic material, a discharge spring 214 for biasing the valve 213 to close the port 212*a*, and a discharge solenoid 215 provided around the part 211 to open and close the discharge vale 213. There are arranged an upper magnetic discharge path 216 and a lower magnetic discharge path 217 between the discharge solenoid 215 and the discharge coupling part 211. The pump 4*b* further has a plunger 218, a suction valve part 21, a suction valve 219, springs 214, 220, 222 and 223, a suction pipe 227, and a mesh of filter 228. The electromagnetic pump 4*b* is connected to a burning unit 206, a tank 202, and a pump drive control unit in a manner as described below. In the meantime, the pump drive control unit 230 includes a discharge solenoid control unit 240 and a plunger solenoid control unit 237. The control unit 237 is comprised of a first pulse generating apparatus 238A which impresses pulses alternately to the upper and lower solenoids 224B and 224C, and a second pulse generating apparatus 238B which impresses pulses to either the upper or the lower solenoid 224B and 224C.

Figure 12:
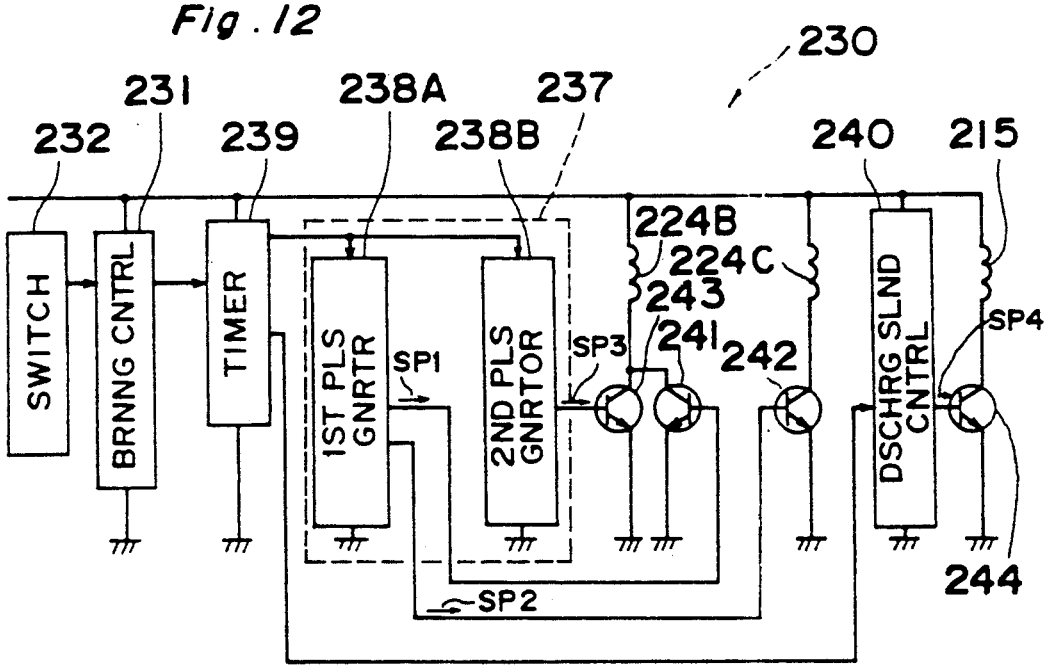
FIG. 12 is an electric circuit showing an example of a control unit of the apparatus shown in FIG. 11.

Referring to FIG. 12, an electric circuit of the pump drive control unit 230 is shown. When a driving start instruction is fed from a switch 232, a burning control unit 231 starts operating. The burning control unit 231 sends a signal to a timer 239 after completion of a predetermined sequence of operation, thereby actuating the plunger solenoid controlling unit 237 and the discharge solenoid control unit 240 to start and stop burning. A transistor 241 is driven by a pulse signal SP1 from the first pulse generating apparatus 238A, feeding electricity to the upper solenoid 224B. A transistor 242 is activated by a pulse signal SP2 from the first pulse generating apparatus 238A, with turning the lower solenoid 224C on. On the other hand, a transistor 243 is driven by a pulse signal SP3 from the second pulse generating apparatus 238B thereby pulse-driving the upper solenoid 224B. A transistor 244 is started by a signal SP4 from the discharge solenoid control unit 240 to supply power to the discharge solenoid 215.

Figure 11:
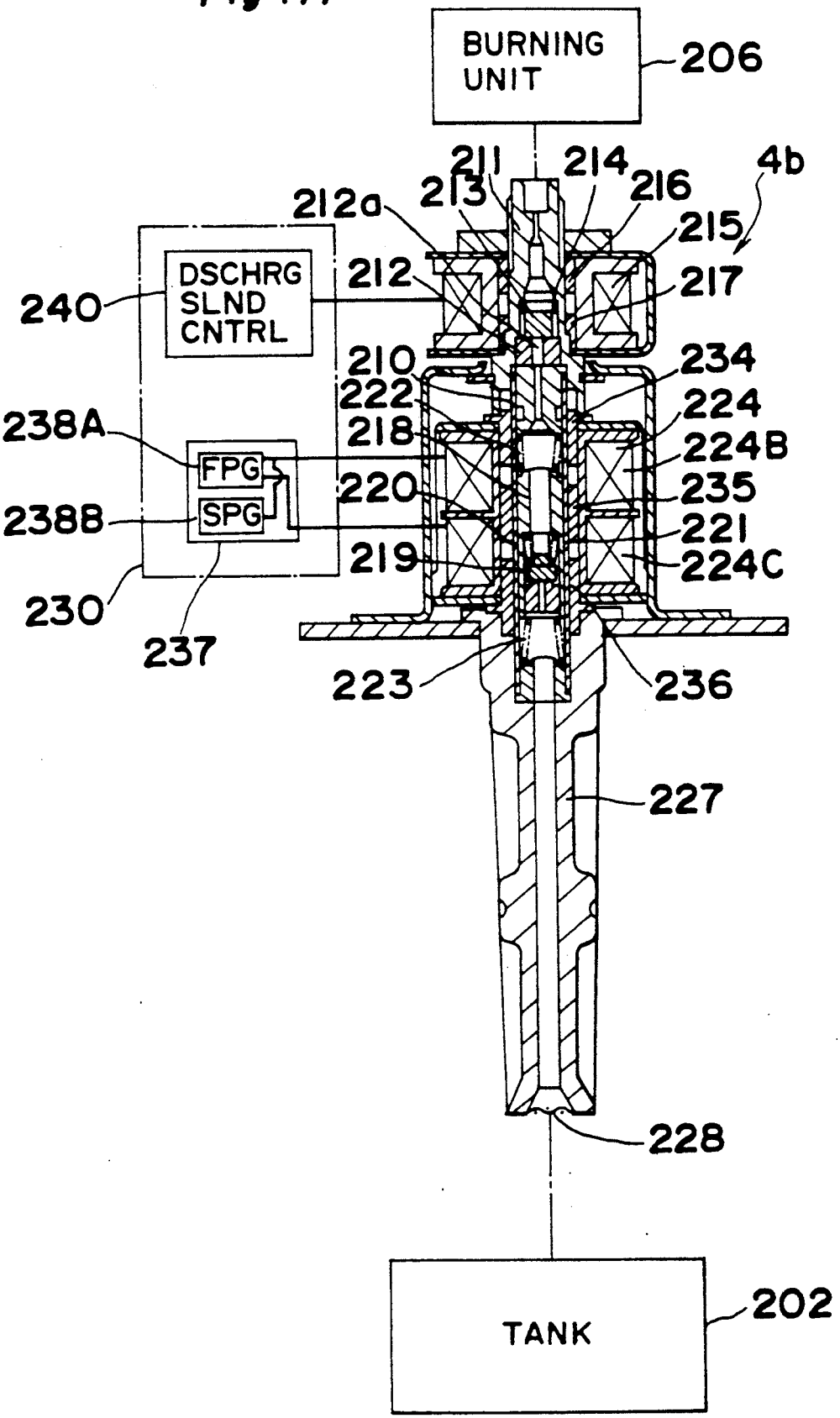
FIG. 11 is a cross sectional view of an electromagnetic pump used in a liquid fuel feeding apparatus according to a third embodiment of the present invention.
Figure 13A:
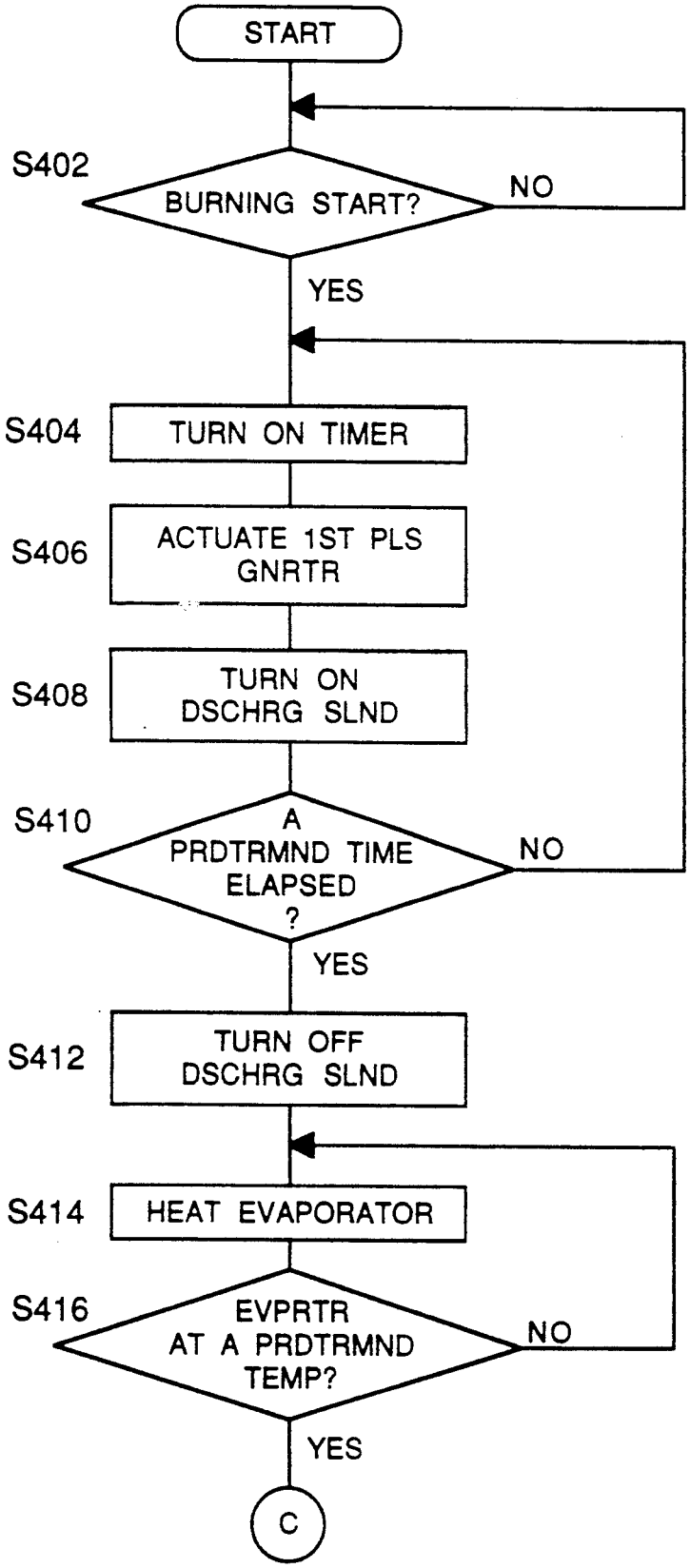
FIGS. 13A and 13B are flow charts of the operation of the control unit of the apparatus shown in FIG. 11 at the ignition/extinguishment time.
Figure 13B:
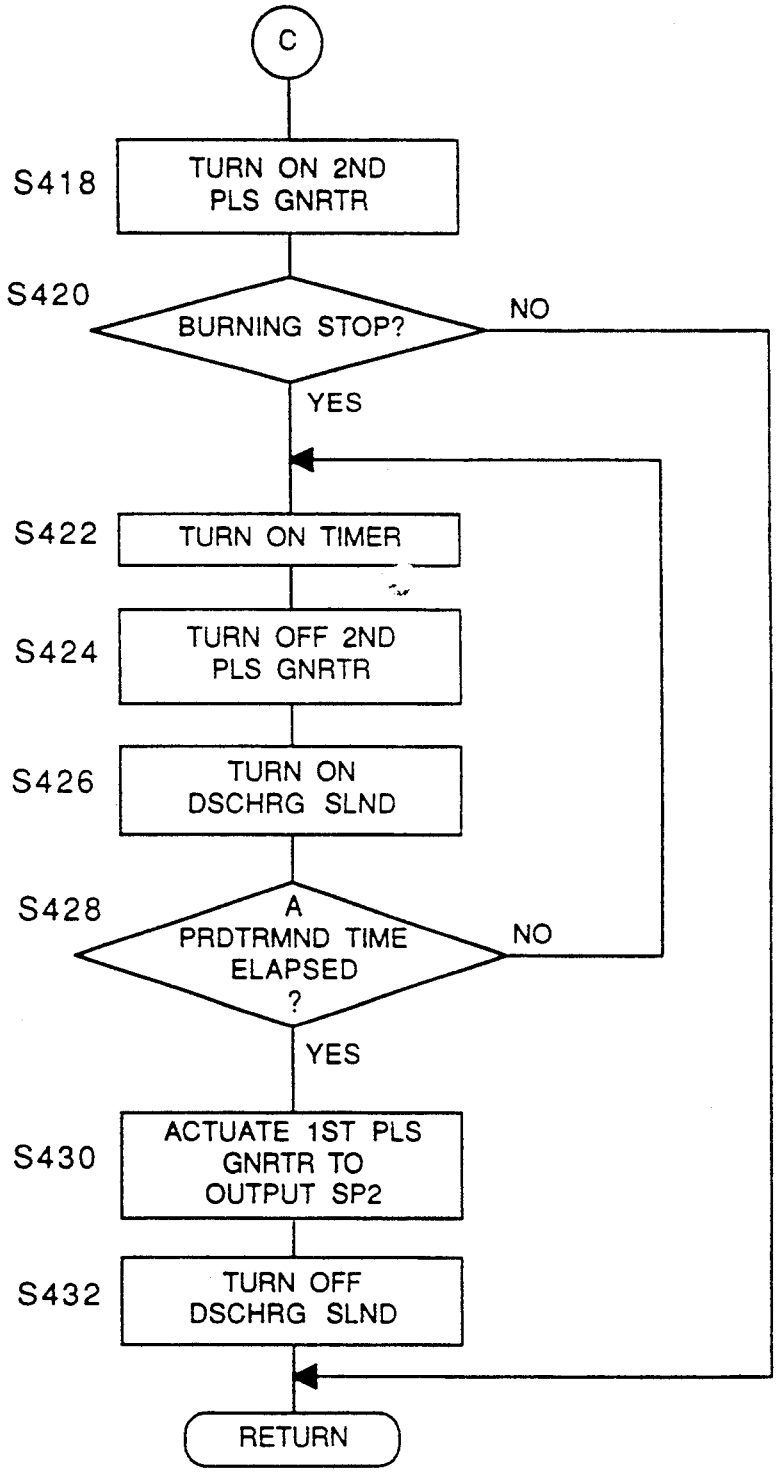

Referring to FIG. 13, a flow chart of the liquid fuel feeding operation of the apparatus shown in FIG. 11 is described. In the above-described structure, in order to supply the liquid fuel, the burning control unit 231 turns on the timer 239 in response to a burning start instruction, with driving the first pulse generating apparatus 238A, and also driving the discharge solenoid controlling unit 240.

On detection of a burning start instruction at step S402, the burning control unit 231 turns on the timer 239 at step S404, so that the first pulse generator 238A is activated at step S406. The upper solenoid 224B is first turned on to raise the plunger 218 upward. At the same time, the discharge solenoid 215 is driven at step S410 to hold the discharge valve 213 in the opened state for several seconds at step S410. Thereafter, the lower solenoid 224C is turned on the pulse signal SP2 output from the first pulse generating apparatus 238A. The plunger 218 is lowered more than during the normal operation, whereby the fuel in the fuel feed pipe 205 is sucked. Since the electricity is supplied alternately to the divided two solenoids 224C, the stroke of the plunger 218 is made maximum to increase the suction force, and therefore the returning amount of the fuel is increased. Thereafter, the power supply to the discharge solenoid 15 is stopped at step S412, and the power supply to the lower solenoid 224C is stopped as well. The discharge valve 13 is closed and start heating of the evaporating unit at step S414. When the evaporating unit becomes a predetermined temperature at step S416, the second pulse generating apparatus 238B is driven at step S418 to turn on and off the upper solenoid 224B alone to start burning by normal operation.

Then, when a burning stop instruction is detected at step S420, the timer 239 is driven at step S422 and stops the operation of the second pulse generating apparatus 238B at step S224, thereby cutting the power supply to the upper solenoid 224B. Subsequently, the first pulse generating apparatus 238A is activated to output the pulse signal SP1 which raises the supplying voltage gradually. The upper solenoid 224B is turned conductive. Approximately at the same time, the discharge solenoid controlling unit 240 is started working to supply electricity to the discharge solenoid 215 for a predetermined time (several seconds) at steps S426 and S428, thereby opening the discharge valve 13. Until an elapse of a predetermined time is detected at step 428, the steps 422, S424, and S426 is repeated. The predetermined time afterwards at step S430, the first pulse generating apparatus 238A is actuated to output the pulse signal SP2 to supply the power to the lower solenoid 224C. As a consequence, the plunger 218 is rapidly and greatly lowered, allowing the fuel to be sucked.

Figure 14:
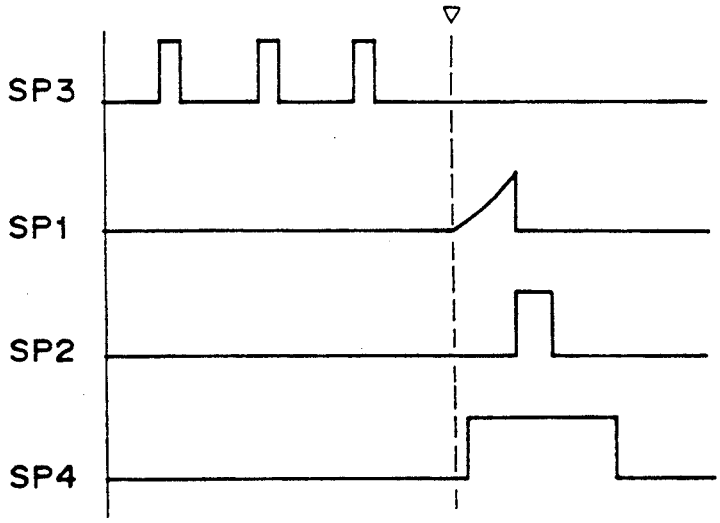
FIG. 14 is a graph showing a waveforms of pulse signals produced by the control unit shown in FIG. 13; for driving the electromagnetic pump.

Referring to FIG. 14, waveforms of pulse signals output from the first and second pulse generating apparatus 238A and 238B, and the discharge solenoid control unit 340 at the extinguishment time.

As discussed hereinabove, according to the third embodiment of the present invention shown in FIG. 11, the plunger 218 is moved downward more greatly at the ignition time or extinguishment time to return the fuel than during the normal operation. Therefore, an increased amount of the fuel can be returned to the electromagnetic pump 4*b* or tank 202. Since the power supply for driving the plunger 218 is made alternately to the upper and lower solenoids 224B, 224C, the stroke of the plunger 218 is made maximum and the suction force is increased. As a result, a larger amount of the liquid fuel in the fuel feed pipe 205 can be returned to the electromagnetic pump **4*b* or tank 202** instantaneously.

Accordingly, the expanded amount of the liquid fuel due to the temperature rise of the fuel feed pipe 205 or nozzle at the end of the fuel feed pipe 205 at the ignition time or at the extinguishment time can be returned much more, so that the generation of the unburnt gas, odd smell or tar can be positively reduced, and favorable burning can be realized for a long term.

In the third embodiment, the solenoid 224 is divided into two stages. However, it is possible to divide the solenoid in a larger number of stages thereby to control the stroke of the plunger 218 to be wider to increase the suction force.

Figure 15:
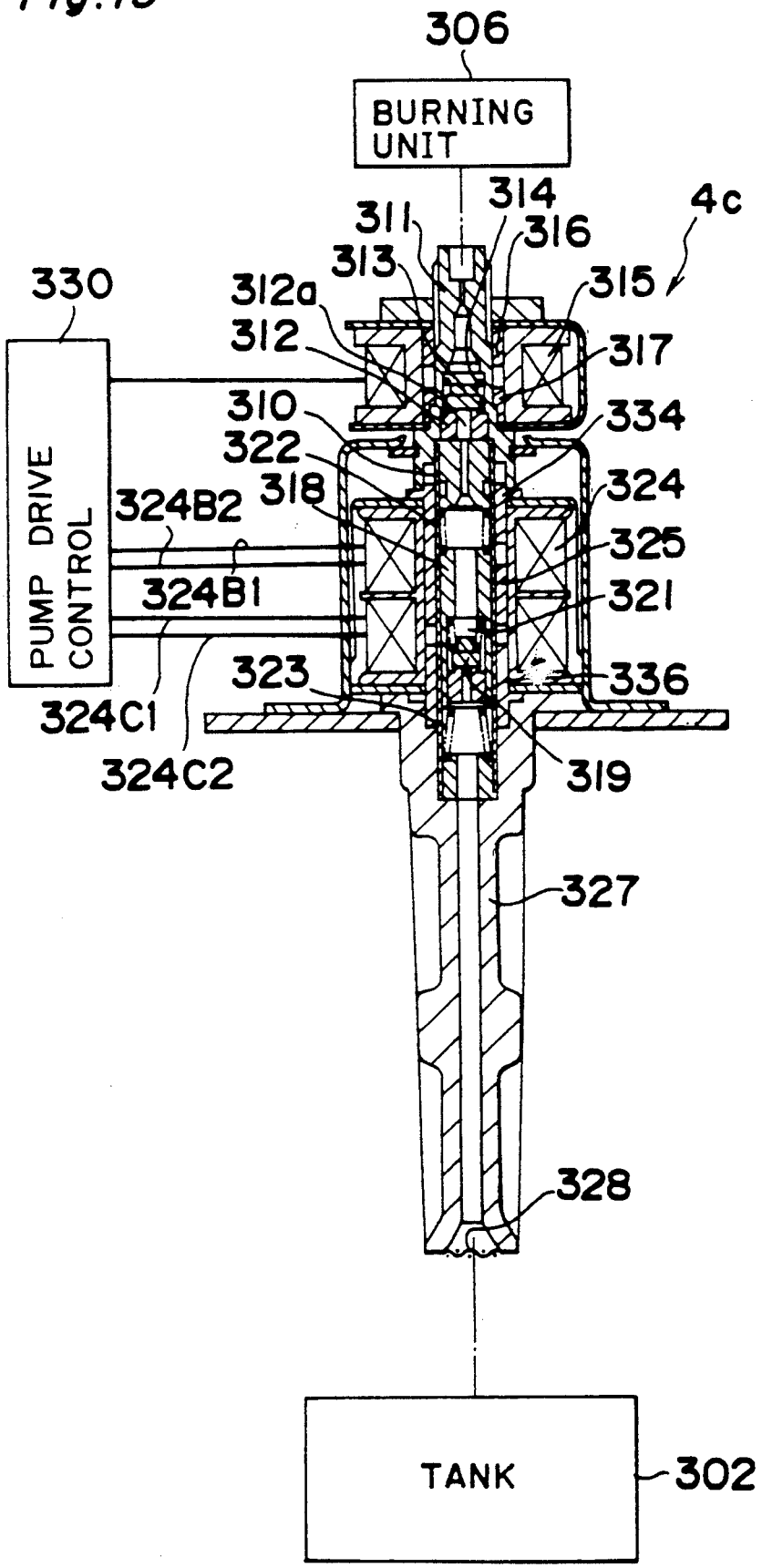
FIG. 15 is a cross sectional view of an electromagnetic pump used in a liquid fuel feeding apparatus according to a fourth embodiment of the present invention.

Referring to FIG. 15, a liquid fuel burning apparatus according to a fourth embodiment of the present invention is shown, whereby the operation of the plunger is made more smooth. In other words, the plunger solenoid 324 is divided into two stages, namely, upper solenoids 324B1 and 324B2 and lower solenoids 324C1 and 324C2. More specifically, the plunger solenoid 324 is formed of four phases. The other points of the structure is very similar to the apparatus as shown in FIG. 11 such that an electromagnetic valve **4*c* has a discharge coupling part 311 coupled to a fuel feed pipe 305 (not shown), a valve seat 312 provided with a discharge port 312*a*, a discharge valve 313 of a magnetic material, a discharge spring 314 for biasing the discharge valve 313 in a close direction, a discharge solenoid 315 provided around the part 311 to open and close the discharge vale 313. There are arranged an upper magnetic discharge path 316 and a lower magnetic discharge path 317 between the discharge solenoid 315 and the discharge coupling part 311. The pump 4*c* further has a tubular column 310, a plunger 318, a suction valve part 321, a suction valve 319, springs 322 and 323 only for supporting the plunger 318 against the gravity, an upper magnetic path 334, an intermediate magnetic path 335, a lower magnetic path 336, a suction pipe 327, and a mesh of filter 328. The electromagnetic pump 4*c* is connected to a burning unit 306, a tank 302, and a pump drive control unit 330** in a manner as described below.

Regarding control of the power supply to each solenoid by the pump drive control unit 330, that is, the power supply to each solenoid for moving up and down the plunger 318, the upper solenoid 324B1 is first turned on to move the plunger 318 to the uppermost position during burning. Then, the upper solenoids 324B1 and 324B2, and lower solenoid 324C1 are turned on to move the plunger 18 down by an approximately ¼ the distance from the uppermost position to the lowest position, and subsequently, the upper solenoid 324B2 and lower solenoid 324C2 are turned on to position the plunger 318 at the intermediate position. Further, the power supply is conducted to the upper solenoid 324B1 and lower solenoids 324C1 and 324C2 to make the plunger 318 descend to approximately ½ from the uppermost position. In the final step, the power is supplied only to the lower solenoid 324C2 to bring the plunger 318 to the lowest position. When this procedure is performed in a reverse direction from the last step to the first one, the plunger 318 is raised from the lowest position to the uppermost position. By controlling and repeating the power supply to the solenoid 324 by the pump drive control unit 330, the plunger 318 can be moved up and down thereby to supply the fuel.

In this case, since the solenoid 324 of the electromagnetic pump **4*c* is constituted of the solenoids 324B1, 324B2 324C1, and 324C2 in the four phases, and when the power supply to each solenoid is controlled as above, the plunger 318** is smoothly driven in five steps from the uppermost position to the lowest position.

If the power supply is changed to be fed, e.g., only to the solenoids 324B1, 324B2, and 324C1, or solenoids 324B1, 324C1, and 324C2, it becomes possible to change the reciprocating stroke of the plunger 318 and to optionally select the discharging amount of the fuel.

Since the plunger 318 can be driven only by controlling the power supply to each solenoid as mentioned hereinabove, a spring to move the plunger 318 up and down is not necessitated, making it unnecessary to take the surge or the like into consideration. Therefore, the cycle of the up-and-down movement of the plunger is enhanced and the fuel discharge by the electromagnetic pump is made smooth, and moreover, the discharging amount of the fuel is remarkably increased. Since a spring for moving the plunger 318 is not employed, the force to move the plunger 318 can be restricted small, and each solenoid can be made compact in size. It is to be noted that since the springs 323 and 324 are provided only for preventing the plunger 328 from dropping down when the solenoids are turned off, the springs 323 and 324 can be made in compact. Furthermore, it is also possible to abolish the springs 323 and 324. Therefore, the electromagnetic pump **4*c*** can be small with a large flow rate.

Although the power supply to the solenoids is controlled concurrently in many phases according to the embodiment of FIG. 15, it may be fed to each solenoid individually or any another supplying method may be used so long as the plunger 318 is driven smoothly. Besides, although the solenoid 324 is divided into two stages and each stage is formed of two wirings, i.e., the solenoid 324 is in the four phases, this is to make smooth the movement of the plunger 318 and to improve the degree of freedom of the reciprocating cycle or stroke of the plunger 318.

Furthermore, although no spring is used to support the plunger 318, such a weak spring that does not cause the surge may be used to initially position the plunger 318.

Figure 16:
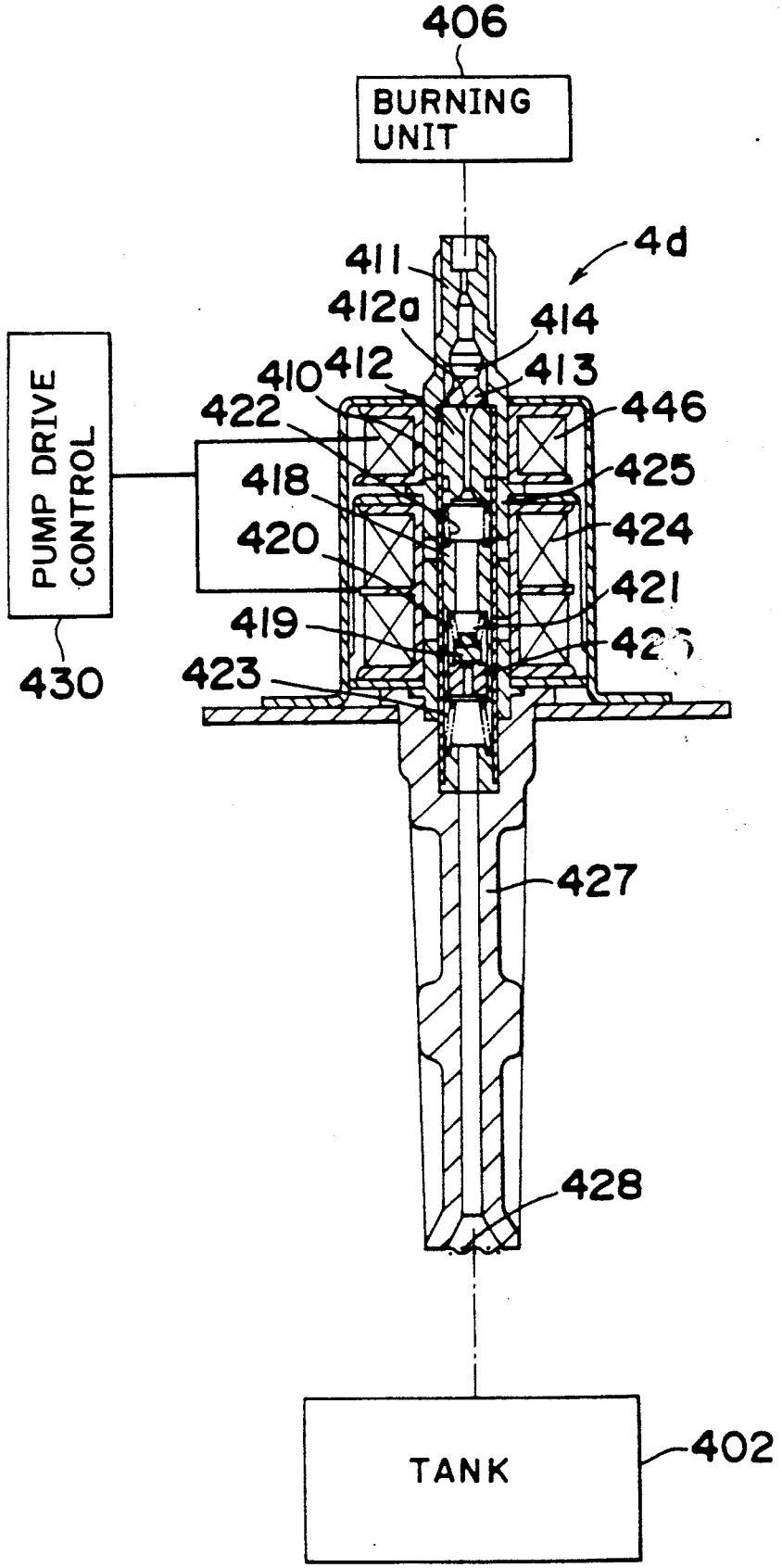
FIG. 16 is a cross sectional view of an electromagnetic pump used in a liquid fuel feeding apparatus according to a fifth embodiment of the present invention.
Figure 17A:
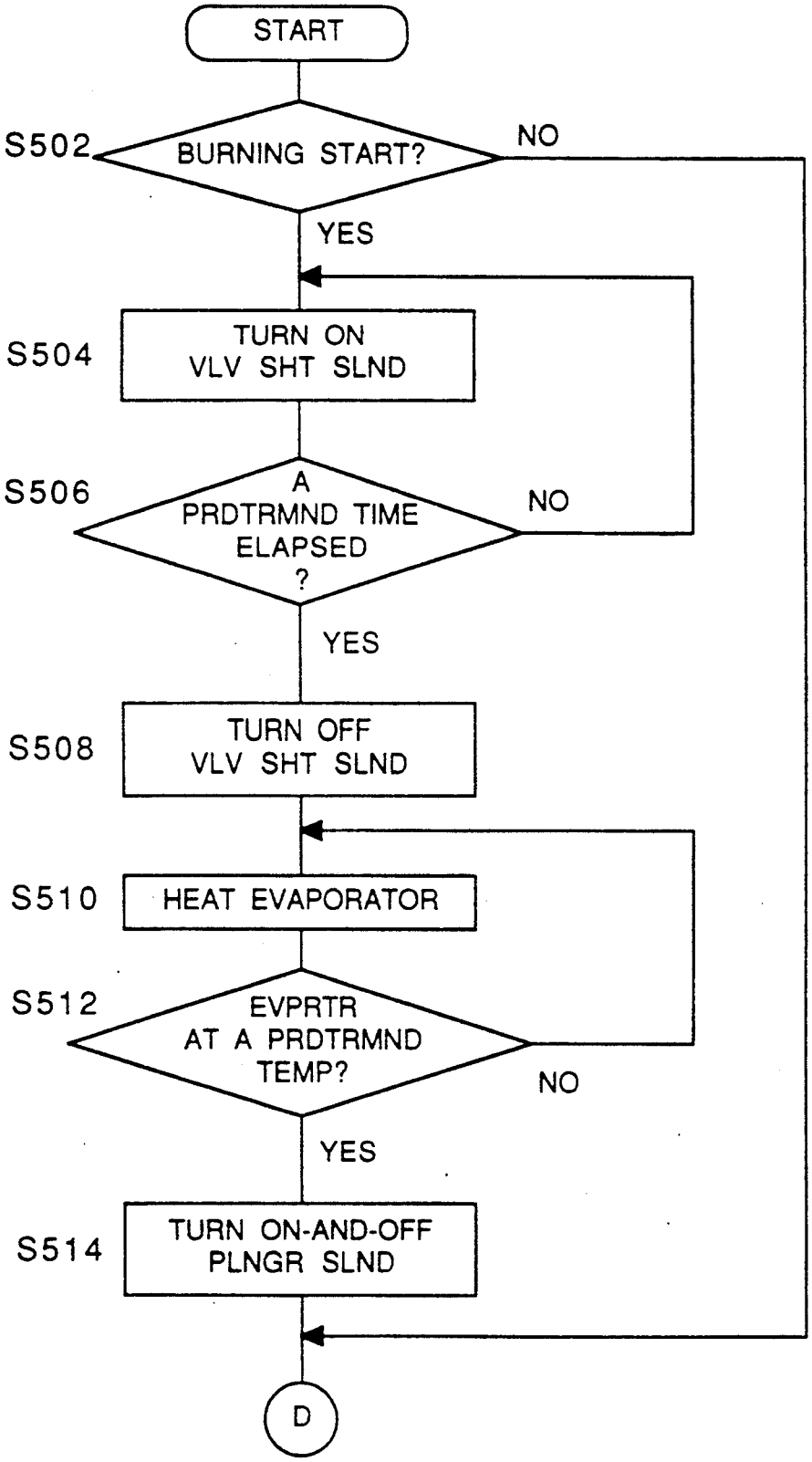
FIGS. 17A and 17B are flow charts of the operation of a controlling unit of the apparatus shown in FIG. 16 at the ignition/extinguishment time.
Figure 17B:
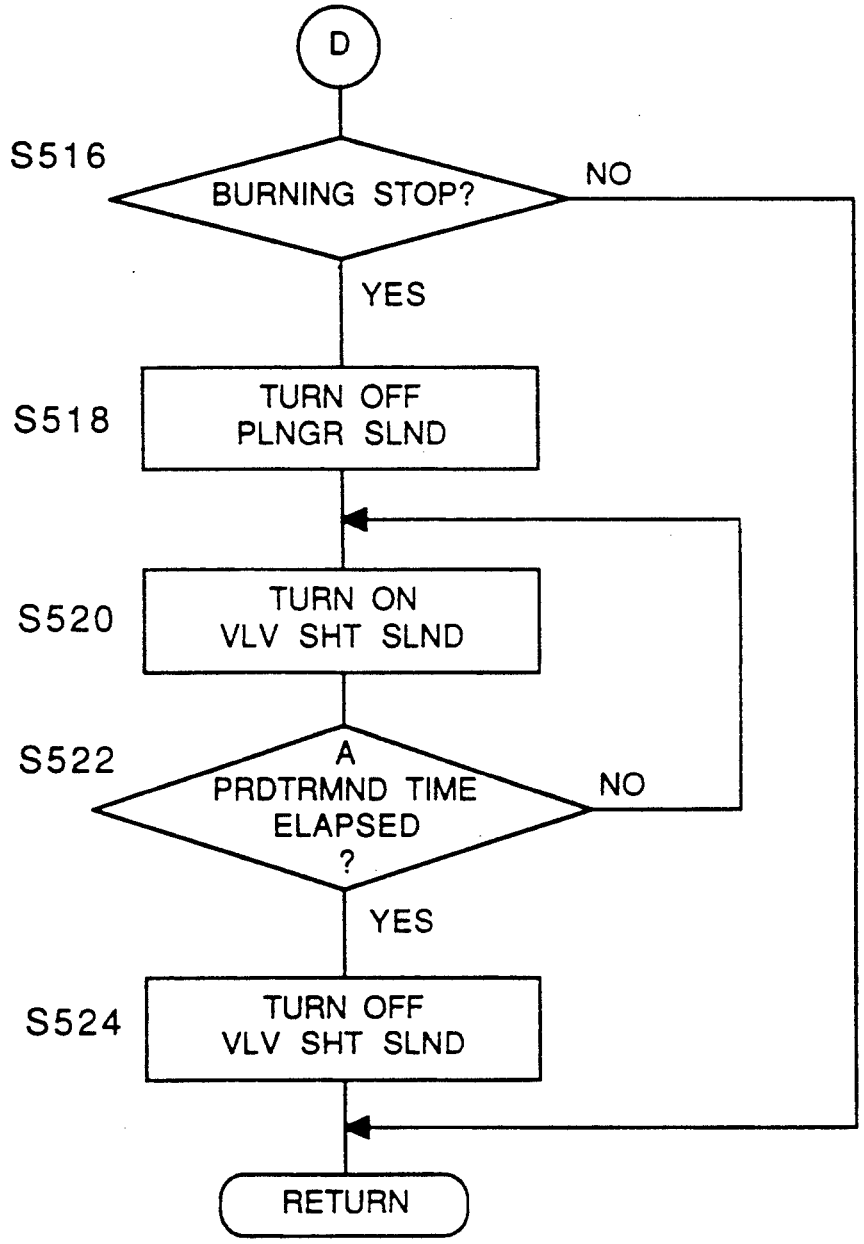
Figure 18:
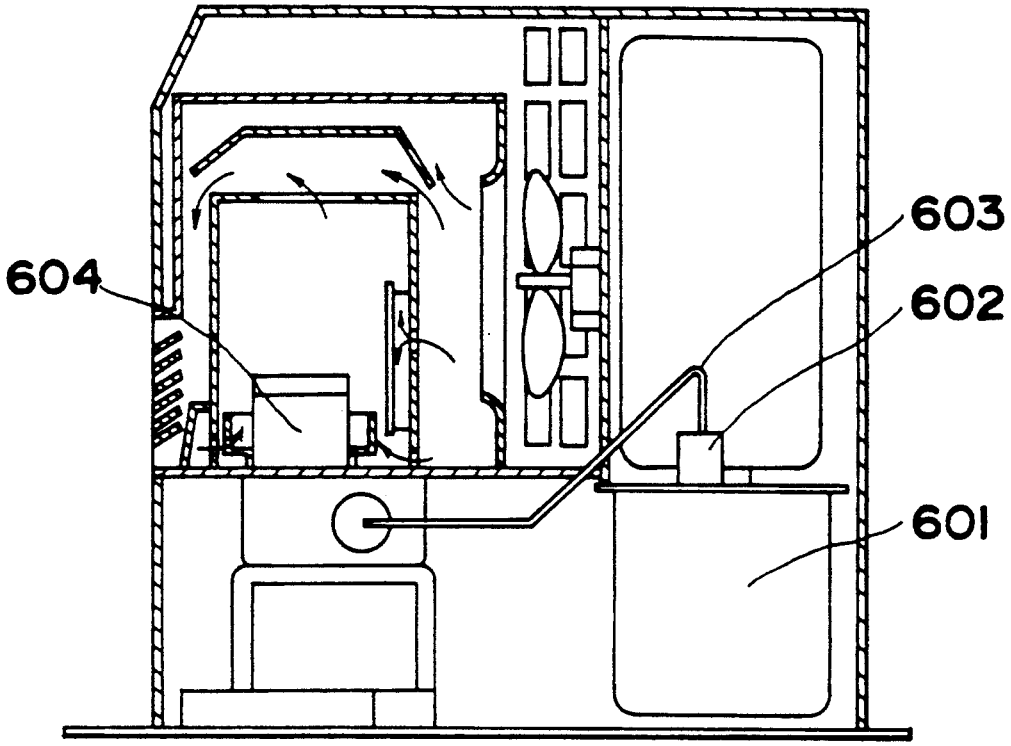
Fig. 18 PRIOR ART
FIG. 18 is a cross sectional view of a warm air circulator using a conventional fuel feeding apparatus.
Figure 19:
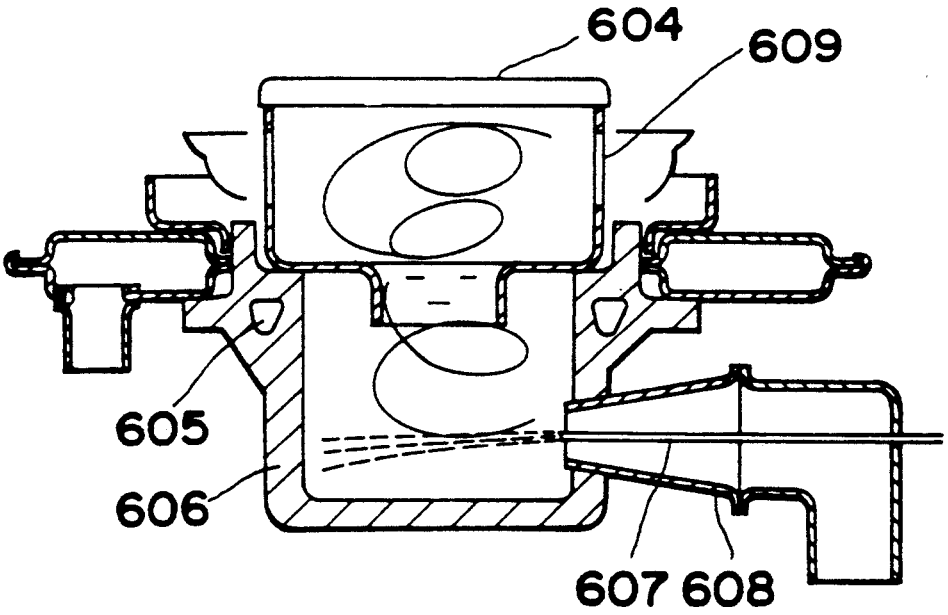
Fig. 19 PRIOR ART
FIG. 19 is a cross sectional view of a burning unit used in the warm air circulator shown in FIG. 18.
Figure 20:
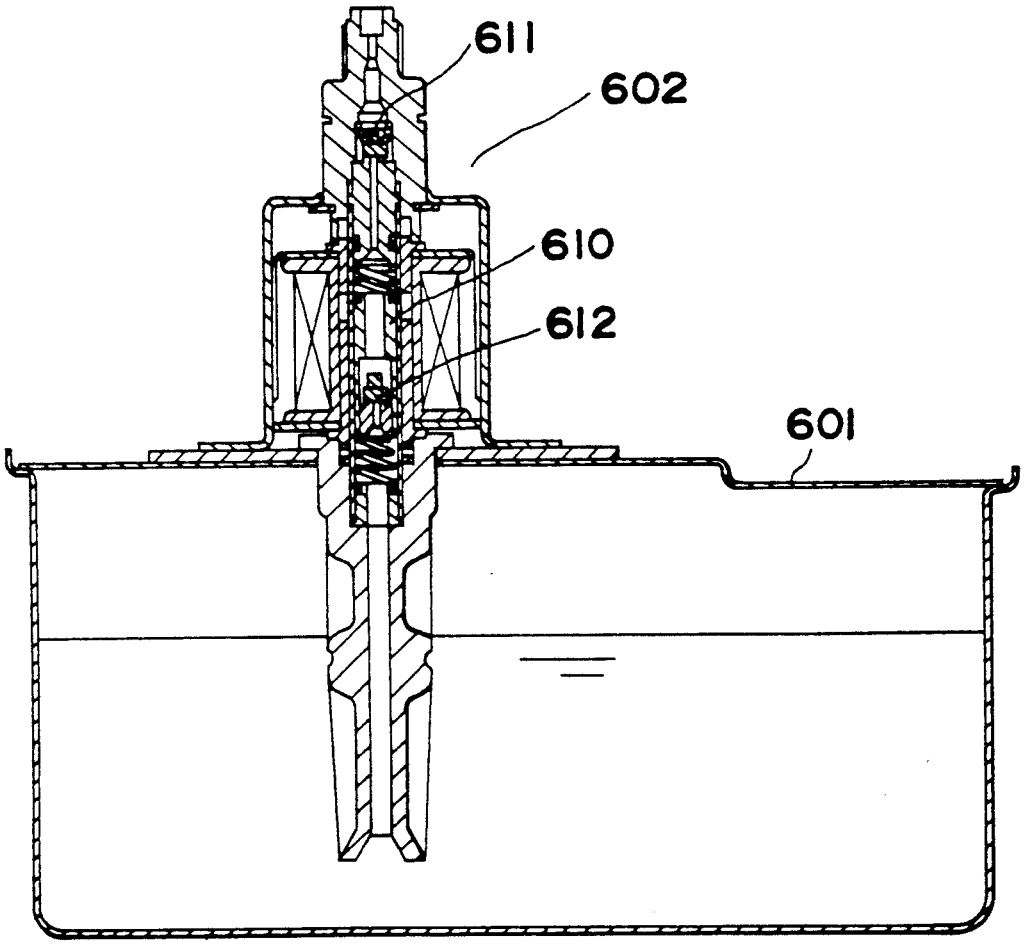
Fig. 20 PRIOR ART
FIG. 20 is a cross sectional view of an electromagnetic pump installed on the tank shown in FIG. 18.

Referring to FIGS. 16 and 17, a liquid fuel burning apparatus according to a fifth embodiment of the present invention is shown, whereby the discharge valve 413 is opened or closed by the repulsive force of the same magnetic poles. For example, the discharge valve 413 is formed of a permanent magnet, the valve seat side of which is N pole. When the liquid fuel is discharged, the discharge valve 413 is opened by the liquid pressure. When the liquid fuel is sucked, the discharge valve 413 is closed by the discharge spring 414 and adhesion force. Meanwhile, a valve seat solenoid 446 in the outer periphery of a valve seat 412 having a discharge port **412*a* is turned on, thereby generating the same pole (N pole) at the side of the discharge valve when the discharge valve 413 is to be opened. The other points of the structure is very similar to the apparatus as shown in FIG. 1 such that an electromagnetic valve 4*d* has a discharge coupling part 411 coupled to a fuel feed pipe 405 (not shown). There are arranged an upper magnetic discharge path 425 and a lower magnetic discharge path 317. The pump 4*d* further has a tubular column 410, a plunger 418, a plunger solenoid 424, a suction valve part 421, a suction valve 419, springs 420, 422 and 423, a suction pipe 347, and a mesh of filter 428. The electromagnetic pump 4c is connected to a burning unit 406, a tank 402, and a pump drive control unit 430** in a manner as described below.

In FIG. 17, upon detection of a burning start instruction at step S502, a burning control unit 431 (not shown) outputs the instruction to the pump drive control unit 430 as to turn on the valve seat solenoid 446 at step S504. The control unit 430 is kept as turned on for a predetermined time (several seconds) at step S506 to open the discharge valve 413. In other words, when the valve seat solenoid 446 is turned on, N pole is brought about to the discharge valve seat 412 at the side of the discharge valve 413. The discharge valve 413 is separated by the repulsive force between the same poles, and is accordingly opened.

After the power supply to the valve seat solenoid 446 is stopped at step S508 to close the discharge valve 413, the burning control unit 431 starts heating of the evaporating unit at step S510. When the evaporating unit reaches a predetermined temperature at step S512, the solenoid 424 is intermittently turned on and off at step S514 to start burning.

Then, when receiving a burning stop instruction at step S516, the electric power supply to plunger solenoid 424 is cut off to turn off the solenoid 424 at step S518. The valve sheet solenoid 446 is kept turned on for a predetermined time (several seconds) at steps S520 and S522, causing the discharge valve 446 to open. The power supply is shut and the discharge valve 413 is closed at step S524.

Accordingly, in this fifth embodiment shown in FIGS. 16 and 17, the fuel in the nozzle at the end of the fuel feed pipe 405 can be sucked at the ignition time or extinguishment time, thereby preventing the expanded amount of the fuel from being supplied to the burning unit 406. Uncomfortable generation of the unburnt gas, smell, tar or the like can be reduced.

In the foregoing description of the preferred embodiments, the problems at the ignition time and extinguishment time are separately solved or simultaneously solved in the form of a combination of the problems. The combination may be arranged suitably. Moreover, the structure may be changed within the scope of the present invention.

As is clear from the above embodiments of the liquid fuel feeding apparatus, the expanded amount of the liquid fuel due to the temperature rise of the fuel feeding path such as the fuel feed pipe or nozzle, etc. at the ignition time or extinguishment time is collected to the fuel supplying/driving means or the tank when the valve means in the fuel supplying/driving means is opened, or collected to the fuel supplying/driving means or the tank when the valve means is opened and the fuel send-out means is driven. Therefore, the unnecessary liquid fuel is never supplied to the burning unit, so that the unburnt gas, smell or tar which would be generated when the expanded fuel is evaporated in the burning unit can be avoided. Moreover, such an advantage as above is achieved only by improving the fuel supplying/driving means itself, without requiring a special suction means to be provided in the middle of the fuel feeding path. Further, since the valve opening means functions also as the supplying/driving means, the liquid fuel feeding apparatus of the present invention is simplified in structure and cost-saving.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. In a burning apparatus provided with a fuel sucking means coupled to a valve means for sucking liquid fuel from a tank means and providing it to a burning means in response to a burning start signal and a burning stop signal, a method for providing said liquid fuel comprising the steps of:

a) sucking said liquid fuel from said tank means in response to said burning start signal;

b) discharging said sucked liquid fuel from said sucking means through said valve means toward said burning means in response to said burning start signal;

c) ceasing said sucking and discharging of said liquid fuel in response to said burning stop signal;

d) opening said valve means for a predetermined period of time in response to the burning stop signal such that discharged liquid fuel which has not reached said burning means can return through said valve means to one of 1) said fuel sucking means and 2) said tank means.

2. A liquid fuel burning apparatus comprising:

tank means for storing a liquid fuel therein;

burning means for burning said liquid fuel;

fuel path means for providing a path between said tank means and said burning means;

control means for producing control signals; and electromagnetic pump means disposed within said fuel path means for sucking liquid fuel from said tank means and discharging said sucked liquid fuel toward said burning means in response to control signals, said electromagnetic pump comprising:

plunger means for sucking said liquid fuel from said tank means into said fuel path means and discharging said sucked liquid fuel toward said burning means;

discharge means for controlling the discharge of said sucked liquid fuel by said plunger means, wherein said discharge means, in response to a stop sucking control signal, controls the discharge of said sucked liquid fuel such that said discharged liquid fuel substantially at an end of said fuel path means returns to one of 1) said electromagnetic pump means and 2) said tank means.

3. A liquid fuel burning apparatus comprising:

tank means for storing a liquid fuel therein;

burning means for burning said liquid fuel;

evaporating means provided within said burning means for causing said liquid fuel supplied to said burning means to evaporate before burning;

fuel path means for providing a path between said tank means and said burning means;

control means for producing control signals; and electromagnetic pump means disposed within said fuel path means for sucking liquid fuel from said tank means and discharging said sucked liquid fuel toward said evaporating means, said electromagnetic pump comprising:

plunger means for sucking said liquid fuel from said tank means and discharging said sucked liquid fuel toward said evaporating means;

plunger solenoid means for driving said plunger means;

discharge valve means for controlling the discharge of said sucked liquid fuel by said plunger means, wherein said discharge valve means being normally closed but opened by one of 1) pressure caused by said sucked liquid fuel and 2) control signals; and valve opening means for opening, in response to control signals, said discharge valve means for a predetermined time at a time defined by one of 1) before evaporation of said liquid fuel caused by said evaporating means and 2) during evaporation of said liquid fuel caused by said evaporating means when said control means produces a signal to start burning.

4. A liquid fuel burning apparatus comprising:

an electromagnetic pump having a plunger means for sucking liquid fuel and discharging said sucked fuel therefrom;

a solenoid means for driving said plunger means, a discharge valve means biased in a closing direction and being opened by the pressure of said sucked liquid fuel, and a valve opening means for temporarily opening said valve means.

5. A liquid fuel burning apparatus as claimed in claim 4, wherein said solenoid means is composed of a control means for driving said plunger means to continuously feed and suck said liquid fuel when said discharge valve means is opened.

6. A liquid fuel burning apparatus comprising:

a tank means for storing a liquid fuel therein;

a burning means for burning said liquid fuel;

a fuel feeding path means for feeding said liquid fuel in said tank means to said burning means;

a control means for producing signals to control said fuel feeding path means; and a electromagnetic pump means provided in a part of said fuel feeding path for moving the liquid fuel in said tank toward said burning unit in response signals produced by said control means, said electromagnetic pump comprising:

a plunger means for sucking said liquid fuel stored in said tank means and discharging said sucked liquid fuel from said electromagnetic pump means;

a plunger solenoid means for driving said plunger means;

a discharge valve means for discharging said sucked liquid fuel therefrom, said discharge valve means being normally in a closing direction but being opened by the pressure of the liquid fuel sucked by said plunger means; and a valve opening means for temporarily opening said discharge valve means when said control means produces a signal to stop the supply of the liquid fuel, whereby said liquid fuel substantially at an end of said fuel feeding path returns to said tank means.

7. A liquid fuel burning apparatus as claimed in claim 6, wherein said solenoid means drives said plunger means in a manner that said liquid fuel is continuously fed, wherein said liquid fuel substantially at the end of said fuel feeding path is sucked when the discharge valve is closed and said liquid fuel is not sucked when the discharge valve is opened.

8. A liquid fuel burning apparatus as claimed in claim 6, wherein said discharge valve means is comprised of a magnet.

9. A liquid fuel burning apparatus as claimed in claim 8, wherein said valve opening means comprises:

a valve seat means for supporting said discharge valve means; and a solenoid means for causing said valve seat means to have the same pole as that of said discharge valve means, whereby said discharge valve means is moved by the repulsive force between the same poles and opens.

10. A liquid fuel burning apparatus as claimed in claim 9, wherein said plunger solenoid means and said discharge solenoid means are comprised of one unit of solenoid means.

11. A liquid fuel burning apparatus as claimed in claim 6, wherein said plunger solenoid is comprised of a plurality of solenoids means in a reciprocating direction of said plunger means.

12. A liquid fuel burning apparatus as claimed in claim 11, wherein said control means is comprised of a plurality of control means for separately controlling said a plurality of solenoid means, whereby said plurality of solenoid means drives said plunger means with a larger stroke to suck said liquid fuel in said tank means than at least when burning is stopped and during burning.

13. A liquid fuel burni apparatus as claimed in claim 6, wherein said solenoid means drives said plunger means in a manner that said liquid fuel is continuously supplied, said liquid fuel substantially at an end of said fuel feeding path means is sucked when said discharge valve means is opened when said control means produces a signals to stop the supply of the liquid fuel.

14. A liquid fuel burning apparatus as claimed in claim 6, wherein said discharge valve means is comprised of a magnetic material.

15. A liquid fuel burning apparatus as claimed in claim 6, wherein said valve opening means comprises a discharge solenoid means for producing a magnetic force effecting to said discharge valve means to open.

16. A liquid fuel burning apparatus as claimed in claim 15, wherein said plunger solenoid means and said discharge solenoid means are comprised of one unit of solenoid means.

17. A liquid fuel burning apparatus comprising:

a tank means for storing a liquid fuel therein;

a burning means for burning said liquid fuel;

a fuel feeding path means connected between said tank means and said burning means for feeding said liquid fuel stored in said tank means to said means of the said burning means;

an evaporating means provided within said burning means for preheating to evaporate said liquid fuel supplied to said burning means before burning;

a control means for producing signals to control said fuel feeding path means; and an electromagnetic pump provided in a part of said fuel feeding path means for moving said liquid fuel stored in said tank means toward said evaporating means; said electromagnetic pump comprising:

a plunger means for sucking said liquid fuel stored in said tank means;

a plunger solenoid means for driving said plunger means;

a discharge valve means for discharging said sucked liquid fuel therefrom, said discharge valve means being normally in a closing direction and opened by the pressure of said liquid fuel sucked by said plunger means; and a valve opening means for opening said discharge valve means for a predetermined time at least either before starting of preheating of said evaporating part or during preheating of said evaporating part when said control means produces a signal to start burning.

18. A liquid fuel burning apparatus as claimed in claim 17, wherein said solenoid means drives said plunger means in a manner that said liquid fuel is continuously supplied, while said liquid fuel substantially at an end of said fuel feeding path means is sucked when said discharge valve means is opened at a time defined by one of 1) before starting of preheating of said evaporating means and 2) during preheating of said evaporating means.

19. A liquid fuel burning apparatus as claimed in claim 17, wherein said discharge valve means is comprised of a magnetic material.

20. A liquid fuel burning apparatus as claimed in claim 19, wherein said valve opening means comprises a discharge solenoid means for producing a magnetic force effecting to said discharge valve means to open.

21. A liquid fuel burning apparatus as claimed in claim 17, wherein said discharge valve means is comprised of a magnet.

22. A liquid fuel burning apparatus as claimed in claim 21, wherein said valve opening means comprises:

a valve seat means for supporting said discharge valve means; and a discharge solenoid means for causing said valve seat means to have the same pole as that of said discharge valve means, whereby said discharge valve means is moved by the repulsive force between the same poles and opens.

23. A liquid fuel burning apparatus as claimed in claim 22, wherein said plunger solenoid means and said discharge solenoid means are comprised of one unit of solenoid means.

24. A liquid fuel burning apparatus as claimed in claim 22, wherein said plunger solenoid is comprised of a plurality of solenoids means in a reciprocating direction of said plunger means.

25. A liquid fuel burning apparatus as claimed in claim 24, wherein said control means is comprised of a plurality of control means for separately controlling said plurality of solenoid means to drive said plunger means with a larger stroke to suck said liquid fuel in said tank means at a time defined by 1) before starting of preheating of said evaporating means and 2) during preheating of said evaporating means.

* * * * *

UNITED STATES PATENT AND TRADEMARK OFFICE

CERTIFICATE OF CORRECTION

PATENT NO. : 5,282,738
DATED : February 1, 1994
INVENTOR(S) : Oshima, et. al.

It is certified that error appears in the above-indentified patent and that said Letters Patent is hereby corrected as shown below:

Column 14, line 24, after the "signeal;" insert --and--.
Column 15, line 8, the word "wherein" should be deleted.
Column 16, line 38, the word "signals" should --signal--.
Column 18, line 18, the number "22" should be --17--.

Signed and Sealed this

Thirtieth Day of August, 1994

*Attest:*

*Attesting Officer*

Bruce Lehman

BRUCE LEHMAN

*Commissioner of Patents and Trademarks*